US007563150B2

(12) United States Patent
Yamaguchi et al.

(10) Patent No.: US 7,563,150 B2
(45) Date of Patent: Jul. 21, 2009

(54) REMOTE CONTROL TOY SYSTEM AND TRANSMITTER AND MOVING MACHINE FOR THE SAME

(75) Inventors: Takashi Yamaguchi, Tokyo (JP); Ryoji Hayashi, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 722 days.

(21) Appl. No.: 10/496,931

(22) PCT Filed: Nov. 29, 2002

(86) PCT No.: PCT/JP02/12497

§ 371 (c)(1),
(2), (4) Date: Jul. 8, 2004

(87) PCT Pub. No.: WO03/045522

PCT Pub. Date: Jun. 5, 2003

(65) Prior Publication Data

US 2005/0085159 A1 Apr. 21, 2005

(30) Foreign Application Priority Data

Nov. 29, 2001 (JP) ..... 2001-364344

(51) Int. Cl.
*A63H 30/00* (2006.01)

(52) U.S. Cl. ..... 446/454

(58) Field of Classification Search ..... 463/5, 463/49; 434/16; 446/454
See application file for complete search history.

(56) References Cited

U.S. PATENT DOCUMENTS 4,313,227 A 1/1982 Eder
4,334,221 A * 6/1982 Rosenhagen et al. ..... 463/6
4,938,483 A * 7/1990 Yavetz ..... 463/5
5,127,658 A * 7/1992 Openiano ..... 463/50
5,690,491 A * 11/1997 FitzGerald et al. ..... 434/16
6,261,180 B1 * 7/2001 Lebensfeld et al. ..... 463/49
6,302,796 B1 10/2001 Lebensfeld et al.
6,306,033 B1 10/2001 Niwa et al.
6,945,782 B2 * 9/2005 Isoz et al. ..... 434/16

FOREIGN PATENT DOCUMENTS

JP 01-025887 1/1989
JP 02-280787 11/1990
JP 10-137439 5/1998

* cited by examiner

*Primary Examiner*—Peter DungBa Vo
*Assistant Examiner*—Masud Ahmed
(74) *Attorney, Agent, or Firm*—Darby & Darby P.C.

(57) ABSTRACT

A remote control toy system includes a plurality of sets each including a transmitter and a movable machine controlled on the basis of a control signal transmitted from the transmitter. An attack signal is transmitted from the movable machine on the basis of an attack order contained in the control signal and transmitted from the transmitter in response to an attack operation of a user. Damages due to an attack are processed and executed on a movable machine that has received the attack signal. Each of the movable machines includes a device for storing own offensive power information, a device for generating the attack signal that contains the offensive power information, a device for transmitting the attack signal, and a device for executing processing to make a degree of damage different, according to the offensive power discriminated from the received attack signal.

8 Claims, 13 Drawing Sheets

FIG.6A

| VEHICLE KIND | MAIN GUN POWER | LIFE |
|---|---|---|
| TANK A | 10 | 40 |
| TANK B | 8 | 30 |
| TANK C | 5 | 15 |
| TANK D | 7 | 25 |

FIG.6B

| VEHICLE KIND | NUMBER OF SHELLS | CHARGING TIME |
|---|---|---|
| TANK A | 15 | 5 SEC. |
| TANK B | 25 | 4 SEC. |
| TANK C | 40 | 1.5 SEC. |
| TANK D | 30 | 3 SEC. |

REMOTE CONTROL TOY SYSTEM AND TRANSMITTER AND MOVING MACHINE FOR THE SAME

CROSS-REFERENCE TO PRIOR APPLICATION

This is a U.S. national phase application under 35 U.S.C. §371 of International Patent Application No. PCT/JP02/12497 filed Nov. 29, 2002, and claims the benefit of Japanese Patent Application No. 2001-364344 filed Nov. 29, 2001 which is incorporated by reference herein. The International Application was published in English on Jun. 5, 2003 as WO 03/045522 A3 under PCT Article 21(2).

TECHNICAL FIELD OF THE INVENTION

The present invention relates to a remote control toy system in which a plurality of transmitters mutually individually control operations of a plurality of movable machines prepared so as to be associated with the transmitters and a battle based upon communication is fought among the movable machines.

BACKGROUND OF THE INVENTION

As a toy in which a plurality of movable machines such as tanks are remote-controlled in the same place and firing is conducted among the movable machines, for example, a system disclosed in Japanese Patent Application No. 2713603 is known. In this system, each transmitter includes a device that transmits data for remote-controlling a corresponding movable machine by means of a radio wave. Each movable machine includes a device for emitting infrared rays toward another movable machine, a device for receiving data from the transmitter, and a device for sensing infrared rays of another movable machine. Each movable machine controls its own operation in accordance with data supplied from the transmitter, and emits infrared rays to other movable machines. If the movable machine senses infrared rays emitted by another movable machine, the movable machine judges itself fired upon.

In addition, in the above-mentioned system, a device for managing infrared ray emission time of each movable machine is provided separately from the transmitter and the movable machine. Each movable machine can determine which movable machine has fired upon itself.

In the above-mentioned invention, it is suggested that firing power may be set for each movable machine because it is possible to determine which movable machine has fired. However, its concrete configuration is not shown. Furthermore, there is a problem that a device for managing the infrared ray emission time required for determining the movable machine that has fired must be provided separately from the transmitter and the movable machine, in order to set the firing power for each movable machine. As the system becomes complicated, therefore, the production cost increases.

SUMMARY OF THE INVENTION

An object of the present invention is to provide a remote control toy system capable of delivering an attack that differs in power from movable machine to movable machine against another movable machine and enhancing the interest of a game, without complicating the system configuration or increasing the production cost.

A remote control toy system of the present invention includes a plurality of sets each including a transmitter and a movable machine controlled on the basis of a control signal transmitted from the transmitter. A predetermined attack signal is transmitted from the movable machine on the basis of an attack order, which is contained in the control signal, transmitted from the transmitter in response to a predetermined attack operation of a user. A predetermined processing for causing damage due to the attack is executed in a movable machine that has received the attack signal. In the remote control toy system, each of the movable machines includes a movable machine storage device for storing offensive power information, which indicates own offensive power, an attack signal generation device for generating the attack signal so as to contain the offensive power information or information associated with the offensive power information, an attack signal transmission device for transmitting the generated attack signal, and a damage generation device for discriminating the offensive power from the received attack signal and executing the predetermined processing so as to make a degree of damage different according to the offensive power. The above described object is achieved by such a remote control toy system.

Here, the predetermined processing for causing damage due to the attack includes processing executed as internal processing the user himself or herself cannot recognize, and processing causing some change outside the movable machine so that the user may recognize. In other words, predetermined processing of the present invention for causing damage due to attack includes all processing causing changes according to offensive power.

According to the present invention, information concerning the offensive power of a movable machine is included in an attack signal to be transmitted to another movable machine. In addition, when an attack from another movable machine has been detected by receiving an attack signal, predetermined processing is executed so as to make a degree of damage different according to the offensive power, which is discriminated from information concerning offensive power contained in the attack signal. As a result, a remote control toy system capable of delivering an attack that differs in power every movable machine can be implemented. In addition, the movable machine of the present invention can discriminate the offensive power of a movable machine that has attacked on the basis of offensive power information contained in the received attack signal. Therefore, the movable machine need not store information such as a data table for discriminating offensive power of movable machines other than itself. As a result, it is possible to provide other movable machines with effects that differ from movable machine to movable machine, without complicating the system configuration or increasing the production cost.

Furthermore, the remote control toy system of the present invention can include the following modes.

The movable machine storage device may further store damage degree discrimination information for discriminating the degree of damage, and the damage generation device may change the damage degree discrimination information so as to increase the damage as the offensive power becomes greater. In this case, as the offensive power of the attack signal increases, the damage becomes greater. In addition, since the damage degree discrimination information is updated from the initial state, the degree of damage can be changed accumulatively. Therefore, the interest of the game can be enhanced.

The transmitter may include attack order limiting device for limiting inclusion of the attack order in the control signal when a predetermined condition is satisfied. Even if in this case under the predetermined condition the user conducts predetermined attack operation on the transmitter, operation control of the movable machine is executed, but an attack signal is not transmitted from the movable machine, because an attack order is not contained in the control signal supplied from the transmitter. As a result, it is possible to substantially provide capabilities concerning the attack of the movable machines with individualities, without increasing the burden of movable machines. Furthermore, so that the initial states of the offensive power and the damage degree discrimination information, and conditions that causes the limitation of the attack order may differ every set of transmitter and movable machine, setting of them are combined. As a result, it is possible to provide capabilities of sets of transmitter and movable machine with variation. Therefore, the interest of the game can be enhanced.

The transmitter may include transmitter storage device for storing required time information that indicates time required between an attack and next attack. And until the required time elapses after the attack order is included in the control signal, the attack order limiting device may prohibit inclusion of the next attack order in the control signal. In this case, it is supposed that the user conducts predetermined attack operation on the transmitter consecutively. Once an attack order is included in a control signal from the transmitter, an attack order is not included in the control signal until predetermined time elapses. As a result, a time period during which an attack signal is not transmitted from the movable machine occurs. Therefore, it is possible to substantially prescribe the time required until the next attack by the movable machine. Accordingly, the interest of the game can be enhanced. For example, the wait time until the next attack is prolonged as the offensive power becomes greater. Thus handicap corresponding to a difference of offensive power is given. As a result, it becomes possible to balance the synthetic capabilities between movable machines and enhance the interest of the battle.

Permissible attack number information for specifying the number of times of permissible attack may be further stored in the transmitter storage device. And the attack order limiting device may update the permissible attack number information whenever the attack order is included in the control signal, and prohibit inclusion of the attack signal in the control signal after the number of times of permitted attacks discriminated by the permissible attack number information has arrived at a predetermined value. Even if in this case the user conducts predetermined attack operation on the transmitter after an attack order is included in the control signal fed from the transmitter by a predetermined number of times, an attack signal is not transmitted from the movable machine, because an attack order is not contained in the control signal supplied from the transmitter. Therefore, it is possible to substantially prescribe the number of times the movable machine can deliver an attack. Accordingly, the interest of the game can be further enhanced. For example, the number of times the movable machine can deliver an attack is reduced as the offensive power becomes greater. Thus handicap corresponding to a difference of offensive power is given. As a result, it becomes possible to balance the synthetic capabilities between movable machines and enhance the interest of the battle.

The movable machine may include a movable machine nonvolatile memory for recording initial states of the offensive power information and the damage degree discrimination information. When predetermined reset operation is conducted, the offensive power information and the damage degree discrimination information stored in the movable machine storage device may be made initial states recorded in the movable machine nonvolatile memory. The transmitter may include a transmitter nonvolatile memory for recording initial states of the required time information and the permissible attack number information. When predetermined reset operation is conducted, the required time information and the permissible attack number information stored in the transmitter storage device may be made initial states recorded in the transmitter nonvolatile memory. In this case, information stored in a storage device of each of the transmitter and the movable machine is initialized in each of the transmitter and the movable machine. As a result, the system is not complicated. Furthermore, since the information is stored on the nonvolatile memory, it is possible to enjoy the same setting repeatedly. By the way, information such as offensive power recorded on the nonvolatile memory may be previously recorded by the manufacturer and the user may be prohibited from rewriting the information. Or the information may be recorded by the user.

The transmitter may include display device for displaying the permissible attack number information. In this case, the transmitter storage device stores the permissible attack number. Therefore, the permissible number of times of attack can be displayed without transmitting data from the movable machine to the transmitter. When a display section were provided on the movable machine, the display section would need to have such a size that the user can read. Therefore, a restraint would occur in the size of the movable machine. However, such a harmful effect is avoided. Therefore, it is advantageous in size reduction of the movable machine.

A movable machine of the present invention conducts operation control on the basis of a control signal transmitted from a transmitter corresponding to the movable machine itself, transmits a predetermined attack signal on the basis of an attack order contained in the control signal, and executes predetermined processing in order to cause damage due to an attack when the attack signal has been received. The movable machine includes a movable machine storage device for storing offensive power information, which indicates own offensive power, an attack signal generation device for generating the attack signal so as to contain the offensive power information or information associated with the offensive power information, an attack signal transmission device for transmitting the generated attack signal, and a damage generation device for discriminating the offensive power from the received attack signal and executing the predetermined processing so as to make a degree of damage different according to the offensive power. By preparing a transmitter corresponding to the movable machine, the remote control toy system of the present invention can be implemented.

The movable machine of the present invention may include various preferable modes in the above described remote control toy system. In other words, the movable machine storage device may further store damage degree discrimination information for discriminating the degree of damage, and the damage generation device may change the damage degree discrimination information so as to increase the damage as the offensive power discriminated from the received attack signal becomes greater. The movable machine may include a movable machine nonvolatile memory for recording initial states of the offensive power information and the damage degree discrimination information, and when predetermined reset operation is conducted, the offensive power information and the damage degree discrimination information stored in the movable machine storage device may be made initial states recorded in the movable machine nonvolatile memory.

A transmitter of the present invention controls a movable machine that conducts operation control on the basis of a received control signal, transmits a predetermined attack signal on the basis of an attack order contained in the control signal, and executes predetermined processing in order to cause damage due to an attack when the attack signal has been received. The transmitter includes attack order limiting device for limiting inclusion of the attack order in the control signal when a predetermined condition is satisfied. A movable machine corresponding to the transmitter of the present invention is prepared. And the movable machine is formed to include a movable machine storage device for storing offensive power information, which indicates own offensive power, an attack signal generation device for generating the attack signal so as to contain the offensive power information or information associated with the offensive power information, an attack signal transmission device for transmitting the generated attack signal, and a damage generation device for discriminating the offensive power from the received attack signal and executing the predetermined processing so as to make a degree of damage different according to the offensive power. As a result, a remote control toy system of the present invention can be implemented.

The transmitter of the present invention may also include various preferable modes in the above described remote control toy system. In other words, the transmitter may include a transmitter storage device for storing required time information that indicates time required between an attack and next attack, and until the required time elapses after the attack order is included in the control signal, the attack order limiting device may prohibit inclusion of the next attack order in the control signal. Permissible attack number information for specifying the number of times of permissible attack may be further stored in the transmitter storage device, and the attack order limiting device may update the permissible attack number information whenever the attack order is included in the control signal, and prohibit inclusion of the attack signal in the control signal after the number of times of permitted attacks discriminated by the permissible attack number information has arrived at a predetermined value. The transmitter may include a transmitter nonvolatile memory for recording initial states of the required time information and the permissible attack number information, and when predetermined reset operation is conducted, the required time information and the permissible attack number information stored in the transmitter storage device may be made initial states recorded in the transmitter nonvolatile memory. The transmitter may include a display device for displaying the permissible attack number information.

Another remote control toy system of the present invention includes a plurality of sets each including a transmitter and a movable machine controlled on the basis of a control signal transmitted from the transmitter. A predetermined attack signal is transmitted from the movable machine on the basis of an attack order contained in the control signal and transmitted from the transmitter in response to a predetermined attack operation of a user. Predetermined processing for causing damage due to the attack is executed in a movable machine that has received the attack signal. In the remote control toy system, each of the transmitters includes a control signal generation device for generating a control signal that includes identification information peculiar to each transmitter for identifying each transmitter, operation control information for controlling operation of the movable machine, and information concerning the attack order, a control signal transmission device for transmitting the control signal, a control signal transmission device for transmitting the control signal, a control signal reception device for receiving a control signal transmitted from another transmitter, a transmission timing setting device for setting transmission timing of the own control signal on the basis of the identification information contained in the received control signal, and a control signal transmission control device for causing the control signal transmission device to transmit the control signal according to the set transmission timing. Each of the movable machines includes an attack signal generation device for generating the attack signal so as to contain the offensive power information or information associated with the offensive power information, an attack signal transmission device for transmitting the generated attack signal, and a control and attack signal reception device for receiving a control signal transmitted from each transmitter and an attack signal transmitted from another movable machine, a movable machine control device responsive to reception of a control signal containing identification information peculiar to a transmitter associated with the own movable machine, for controlling operation of the own movable machine on the basis of operation control information contained in the control signal and controlling generation and transmission of the attack signal on the basis of an attack order contained in the control signal, and a damage generation device responsive to reception of an attack signal from another movable machine, for discriminating the offensive power from the received attack signal and executing the predetermined processing so as to make a degree of damage different according to the offensive power. For each of the transmitters and movable machines, a common signal transmission schedule prescribing transmission timing of the control signal and the attack signal so as to prevent overlapping each other is set. The transmission timing setting device of the transmitter refers to identification information contained in the control signal from another transmitter to discriminates transmission timing of the transmitter itself prescribed in the signal transmission schedule, and the movable machine control device refers to reception timing of a control signal transmitted from at least one transmitter among the transmitters, discriminates its own transmission timing prescribed in the signal transmission schedule, and causes the attack signal transmission device to transmit the attack signal according to the discriminated transmission timing. Thus, the above described object is achieved.

According to the remote control toy system, the movable machine causes an attack signal to be transmitted to another movable machine to include information concerning the offensive power of the movable machine itself. In addition, when an attack from another movable machine has been detected by receiving an attack signal, the movable machine executes processing so as to make a degree of damage different according to the offensive power, which is discriminated from information concerning offensive power contained in the attack signal. As a result, a remote control toy system capable of delivering an attack that differs in power every movable machine can be implemented. In addition, each set of transmitter and movable machine can transmit its own attack signal according to a signal transmission schedule prescribed so that the transmitters and the movable machines will not overlap each other in transmission timing, by the transmitter receive the control signal from another transmitter, and the driving machine referring to reception timing of a control signal transmitted from each transmitter. Therefore, it is possible to transmit control signals from the transmitters and attack signals from the movable machines on the same carrier signal. Each movable machine can advance sharing of reception device and processing system between signals from the transmitter and signals other movable machines. As a result, complication of the configuration of movable machines and increase of power consumption can be advantageously prevented.

BRIEF DESCRIPTION OF THE DRAWINGS

FIGS. 6A and 6B are diagrams showing tables of parameters set for each tank model;

BEST MODE FOR CARRYING OUT THE INVENTION

Figure 1:
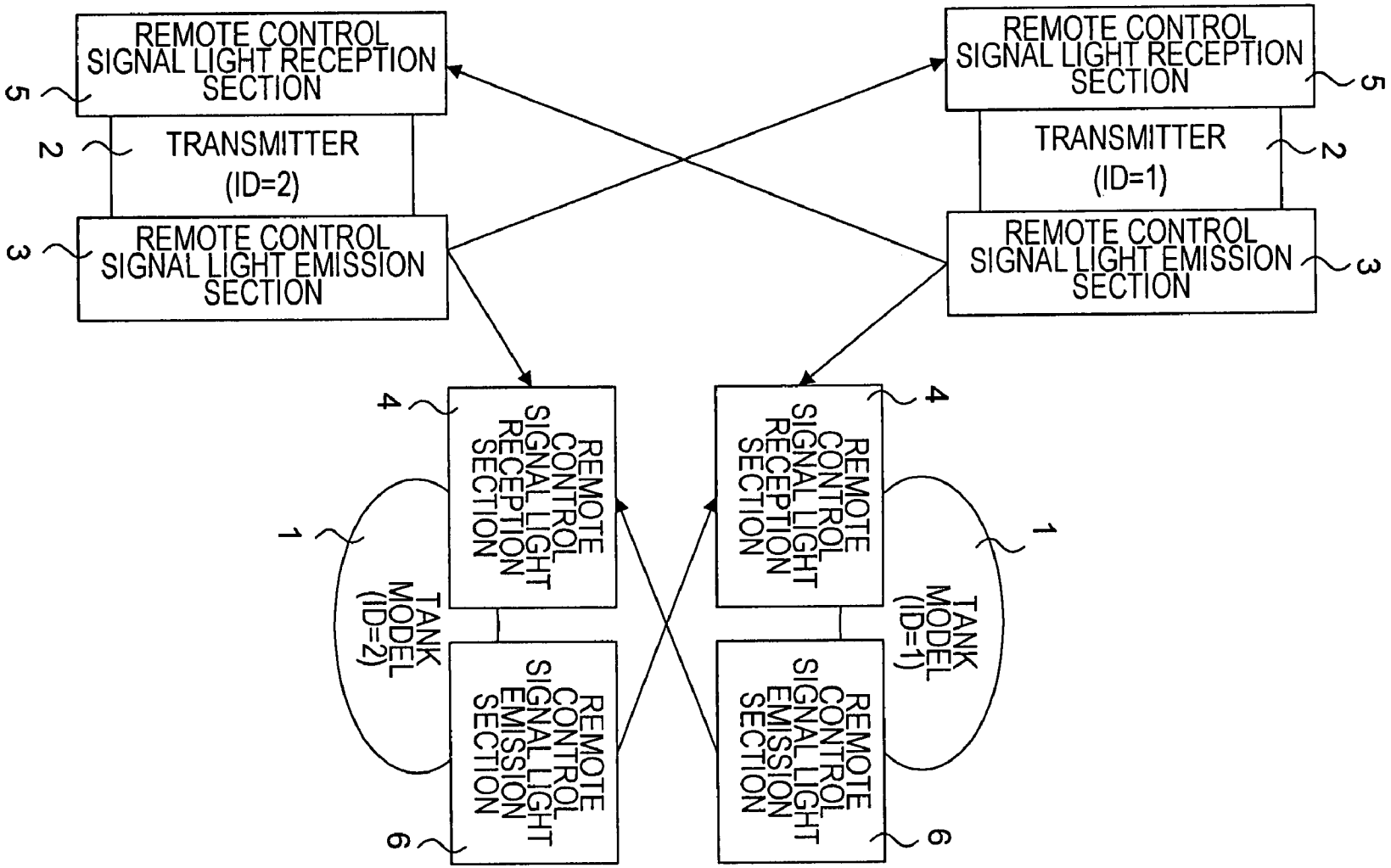
FIG. 1 is a diagram showing a schematic configuration of a remote control toy system according to an embodiment of the present invention.

FIG. 1 is a diagram showing a schematic configuration of the present embodiment. In FIG. 1, there is supposed the case where two tank models 1 . . . 1 are remote-controlled in the same place and a battle is fought between the tank models 1 . . . 1 by means of communication using infrared rays.

Transmitters 2 . . . 2 are prepared so as to be associated with tank models 1 . . . 1, respectively. Numerals 1 and 2 are set in the tank models 1 . . . 1 and the transmitters 2 . . . 2 as Ids, respectively. Each tank model 1 is remote-controlled on the basis of data supplied from a transmitter 2 that is provided with the same ID. Infrared rays are utilized for remote control of each tank model 1. For that purpose, a remote control signal light emission section 3 is mounted on each transmitter 2, and a remote control signal light reception section 4 is mounted on each tank model 1. In addition, in order to achieve synchronization in data transmission from the transmitters 2, a remote control signal light reception section 5 is mounted on each transmitter 2. Infrared rays are also utilized for communication between the tank models 1 . . . 1. For that purpose, a remote control signal light emission section 6 is mounted on each tank model 1 in order to conduct communication with another tank model. The remote control signal light reception section 4 of the tank model 1 receives a signal from a remote control signal light emission section 6 of another tank model 1 as well.

Figure 2:
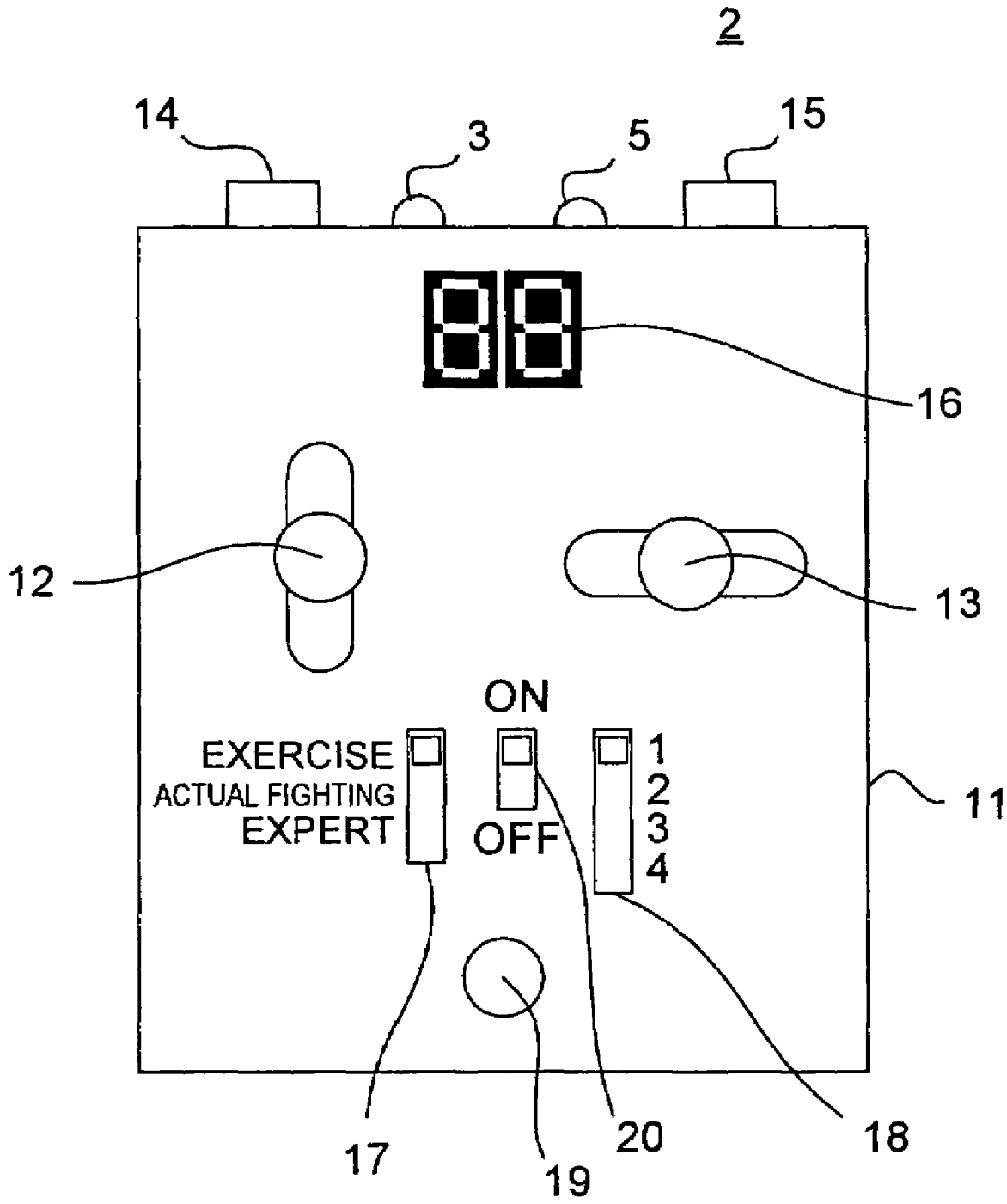
FIG. 2 is a top view of a transmitter for tank model, which is an embodiment of a transmitter.

FIG. 2 is a top view of the transmitter 2, which remote controls the tank model 1. As shown in FIG. 2, the transmitter 2 has a casing 11 formed of resin or the like. On the front of the casing 11, a light emission section 3 for transmitting data to the tank model 1 and a light reception section 5 for receiving data from another transmitter 2 are provided. Furthermore, on the casing 11, there are provided a throttle stick 12 controlled in order to control the traveling direction and velocity of the tank model 1, a revolution/turret revolution stick 13 controlled to control the revolution of the tank model 1 and the revolution of a turret section 32 (see FIG. 3), a turret revolution button 14 controlled to order the turret section 32 to revolve, a firing button 15 for ordering the tank model 1 to fire, a seven-segment display section 16 for displaying the number of shells and so on of the tank model 1, a play mode selection switch 17 for selecting a different game method, an ID setting switch 18 for setting an ID of the transmitter 2, and an ID rewriting button 19 for rewriting the ID of the tank model 1 to make it the same as the ID of the transmitter 2 itself. As for the throttle stick 12, the tank model 1 can be switched to a forward movement and a backward movement by tilting the throttle stick 12 forward or backward from a neutral position corresponding to the velocity 0. The throttle stick 12 outputs a velocity order signal proportionate to the degree of the tilting. The revolution/turret revolution stick 13 functions as an input device for controlling the revolution of the tank model 1 when the throttle stick 12 is not in the neutral position or the turret revolution button 14, which is a pushbutton, is not pressed. When the throttle stick 12 is in the neutral position and the turret revolution button 14 is pressed, the revolution/turret revolution stick 13 functions as an input device for controlling the revolution of the turret section 32 of the tank model 1. If the revolution/turret revolution stick 13 is tilted leftward or rightward from the neutral position corresponding to the straight travel state of the tank model 1 or the stop state of the turret section 32, then a revolution order signal proportionate to the degree of the tilting is output. The firing button 15 is a pushbutton switch. If the firing button 15 is pressed, then a firing order signal is output. Besides the number of shells of the tank model 1, the seven-segment display section 16 displays information, such as a code for indicating a voltage drop of the battery or a code for indicating that an ID is being rewritten, as occasion demands. The play mode selection switch 17 can be switched among three positions corresponding to an exercise mode, an actual fighting mode, and an expert mode, and it outputs a signal according to the position. The ID setting switch 18 can be switched among four positions respectively corresponding to IDs 1 to 4, and it outputs a signal according to the position. The ID rewriting button 19 is a pushbutton. When the ID rewriting button 19 is pressed, an ID rewriting order signal is output. On the transmitter 2, there are also provided a power switch 20 for turning ON/OFF power supply and a charging dock and charging terminals for charging the tank model 1 (not illustrated).

Figure 3A:
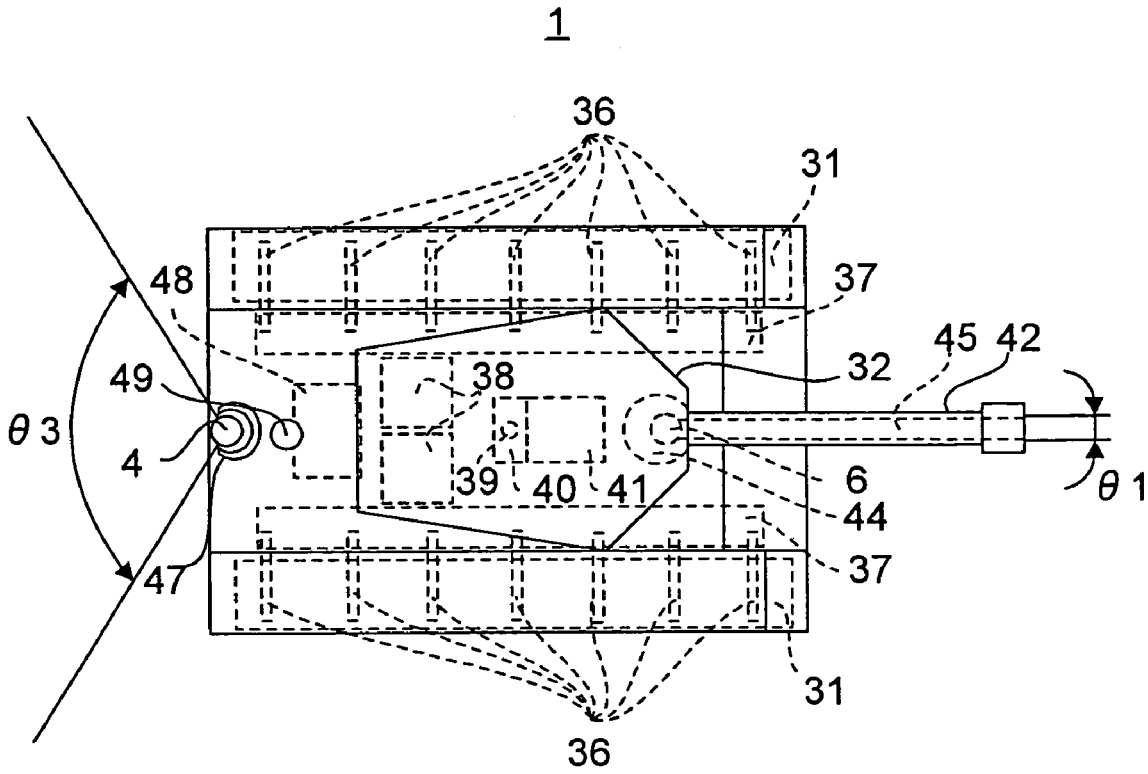
FIGS. 3A and 3B are a plan view and side view of a tank model, which is an embodiment of a transmitter, respectively.
Figure 3B:
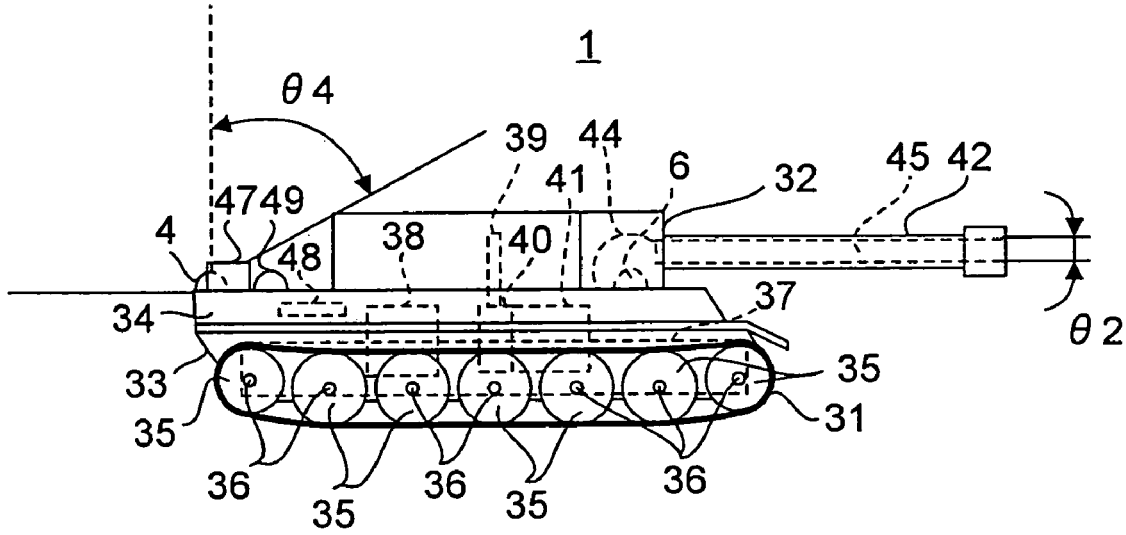

FIG. 3A is a top view of a tank model 1, and FIG. 3B is a side view thereof. The tank model 1 includes a chassis 33 and a body 34 that covers the top of the chassis. On each of the left and right sides of the chassis 33, wheels 35 . . . 35 are provided so as to form a row. One endless track 31 is extended over each of the rows of the wheels 35. (One endless track is extended on each of the left and right sides.) Among the wheels 35 . . . 35 of each row, at least one of the wheels is attached to a travel transmission device 37 via wheel axles 36 . . . 36, and other wheels are attached to the chassis 33 via wheel axles 36 . . . 36 so as to freely rotate. The travel transmission device 37 transmits rotation of a travel motor 38 serving as a driving source to the wheel axels 36 . . . 36. One travel transmission device 37 and one travel motor 38 are provided on each of the left and right sides so as to correspond to each of a pair of left and right endless tracks 31 . . . 31. The left and right endless tracks 31 can be thus driven individually. On top of the body 34, a turret 32 is provided around a shaft 39 so as to be able to revolve. The turret 32 and the shaft 39 can rotate as one body, and a lower end portion of the shaft 39 is attached to a turret section transmission device 40. The turret section transmission device 40 transmits rotation of a turret motor 41, which serves as a driving source, to the shaft 39.

A gun barrel 42 is provided on the turret section 32. On the front part of the turret section 32 to which the gun barrel 42 is attached, a light emission section 6 for transmitting data to another tank model is provided. Infrared rays transmitted from the light emission section 6 is led to optical fiber 45 provided in the gun barrel 42 by a condenser 44. The infrared rays transmitted by the optical fiber 45 are emitted from the tip of the gun barrel 42 in a direction of the gun barrel 42 with predetermined emission angles θ1 and θ2. In the present embodiment, it is supposed that the transmitter 2 is controlled over the tank model 1. If the angles θ1 and θ2 from the gun barrel 42 are narrow, therefore, interference caused by reception in the transmitter 2 of emitted transmission data is avoided.

On the back portion of the body 34, a light reception section 4 for receiving a signal from the transmitter 2 and another tank model 1 is provided. When the light reception section 4 has received data transmitted from the light emission section 6 of another tank model 1, the tank model 1 considers itself to be fired upon, and executes processing of notifying the user that the tank model 1 has been fired upon or predetermined processing serving as a penalty on the game. On the front side of the light reception section 4, a cover 47 for intercepting infrared rays is provided so as to receive signals from other tank models 1 within only a predetermined angle θ3 of the rear. As a result, a game method of validating only firing from the rear, among firing attempts conducted by other tank models 1, can be implemented. The cover 47 is limited in height so that the light reception section 4 may receive a light signal even from the front side so long as it is within a range of an angle of θ4 from the right above. Therefore, remote control from the transmitter 2 disposed over the tank model 1 is not obstructed by the cover 47.

Within the tank model 1, a controller 48 including a microprocessor, an oscillator, a memory, and a motor driver disposed on the same circuit board is provided. The controller 48 determines whether data sent from the light reception section 4 has been transmitted from the transmitter 2 corresponding to its own tank model 1 or transmitted from another tank model 1. If the data is judged to have been transmitted from the transmitter 2 corresponding to its own tank model 1, operation of the travel motors 38 . . . 38 and the turret motor 41 is controlled on the basis of the data and a data is transmitted from the light emission section 6 to another tank model 1. If the data is data from a transmitter 2, but the transmitter is not a transmitter 2 corresponding to its own tank model, then it is determined whether the data is data for ordering ID rewriting. If the data is data for ordering ID rewriting, then the controller 48 rewrites its own ID. If the data is judged to be data from another tank model 1, then the controller conducts predetermined processing to be conducted when the tank model 1 is fired upon. An LED 49 is provide on the back of the tank model 1, and the LED 49 turns on and off and flashes according to, for example, the number of times of being fired upon.

Figure 4:
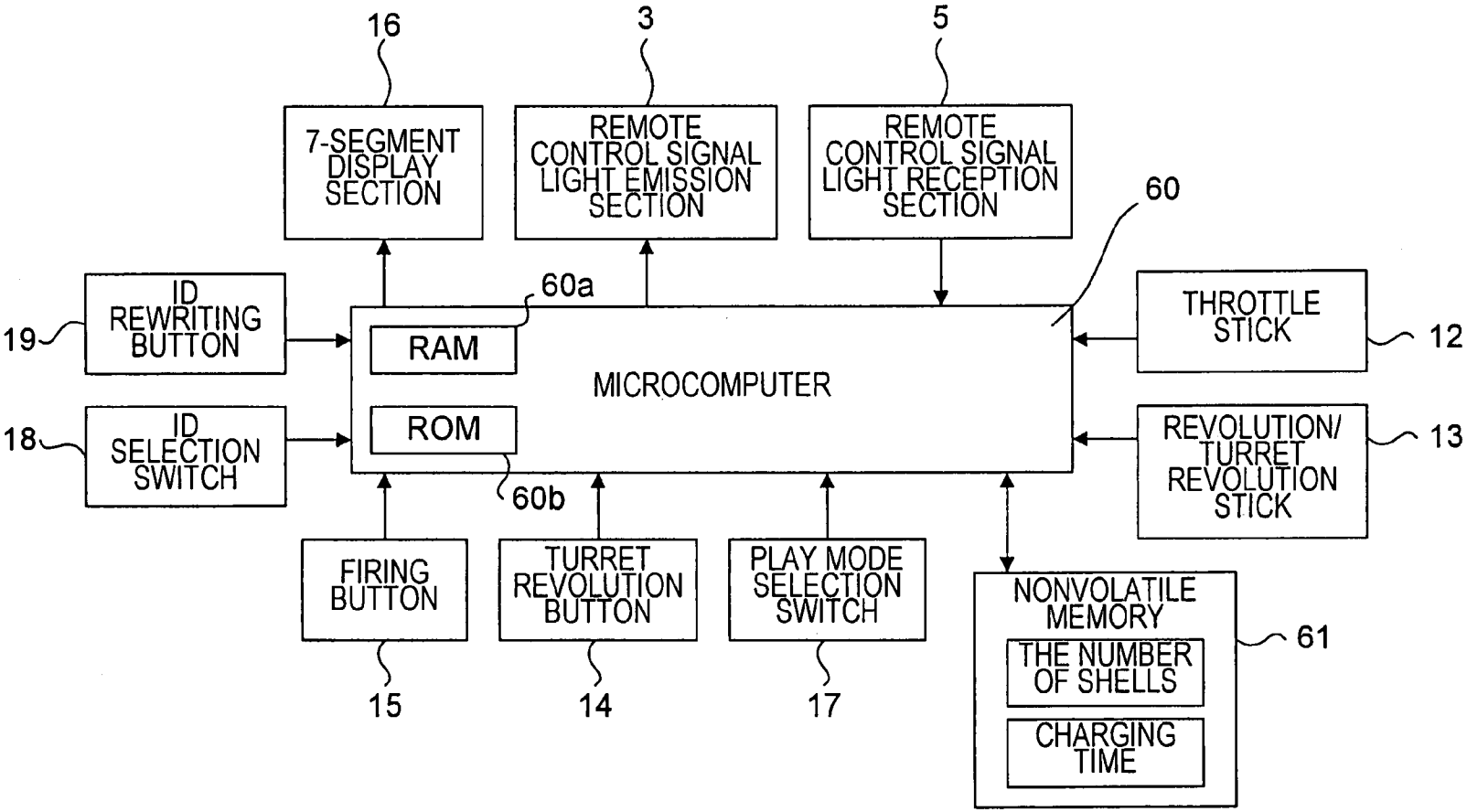
FIG. 4 is a diagram showing a circuit configuration of a transmitter of FIG. 2.

FIG. 4 shows a circuit configuration of the transmitter 2. Signals corresponding to operations of the throttle stick 12, the revolution/turret revolution stick 13, the turret revolution button 14, the firing button 15, the play mode selection switch 17, the ID selection switch 18 and the ID rewriting button 19 are input to a microcomputer 60. The remote control signal light emission section 3 includes light emission device such as an LED, and emits infrared rays according to remote control data generated by the microcomputer 60. Remote control data of one block generated by the microcomputer 60 will be described later (see description of FIG. 7).

On the other hand, the remote control signal reception section 5 shown in FIG. 4 receives infrared rays transmitted from another transmitter 2, and outputs a signal obtained by removable carrier components from the received infrared rays to the microcomputer 60. The microcomputer 60 controls transmission timing of its own data on the basis of the received data. The reason why thus transmission data of another transmitter 2 is received and thereby transmission timing is set is that interference caused by simultaneous transmission of remote control data from a plurality of transmitters 2 and a plurality of tank models 1 should be prevented.

A RAM 60*a* and a ROM 60*b* are mounted on the microcomputer 60 as main storage devices, and in addition, a nonvolatile memory 61 is connected to the microcomputer 60. On the nonvolatile memory 61, information of the number of shells, which prescribes the number of times the tank model 1 can fire in one play, and information of charging time, which prescribes time required since the tank model 1 fires once until the next firing is conducted, are recorded previously.

On the transmitter 2, a power switch 20, an oscillator for providing the microcomputer 60 with a clock signal, and a charging circuit and charging terminals for charging a secondary battery, which serves as a power supply of the tank model 1, are provided (they are not illustrated).

Figure 5:
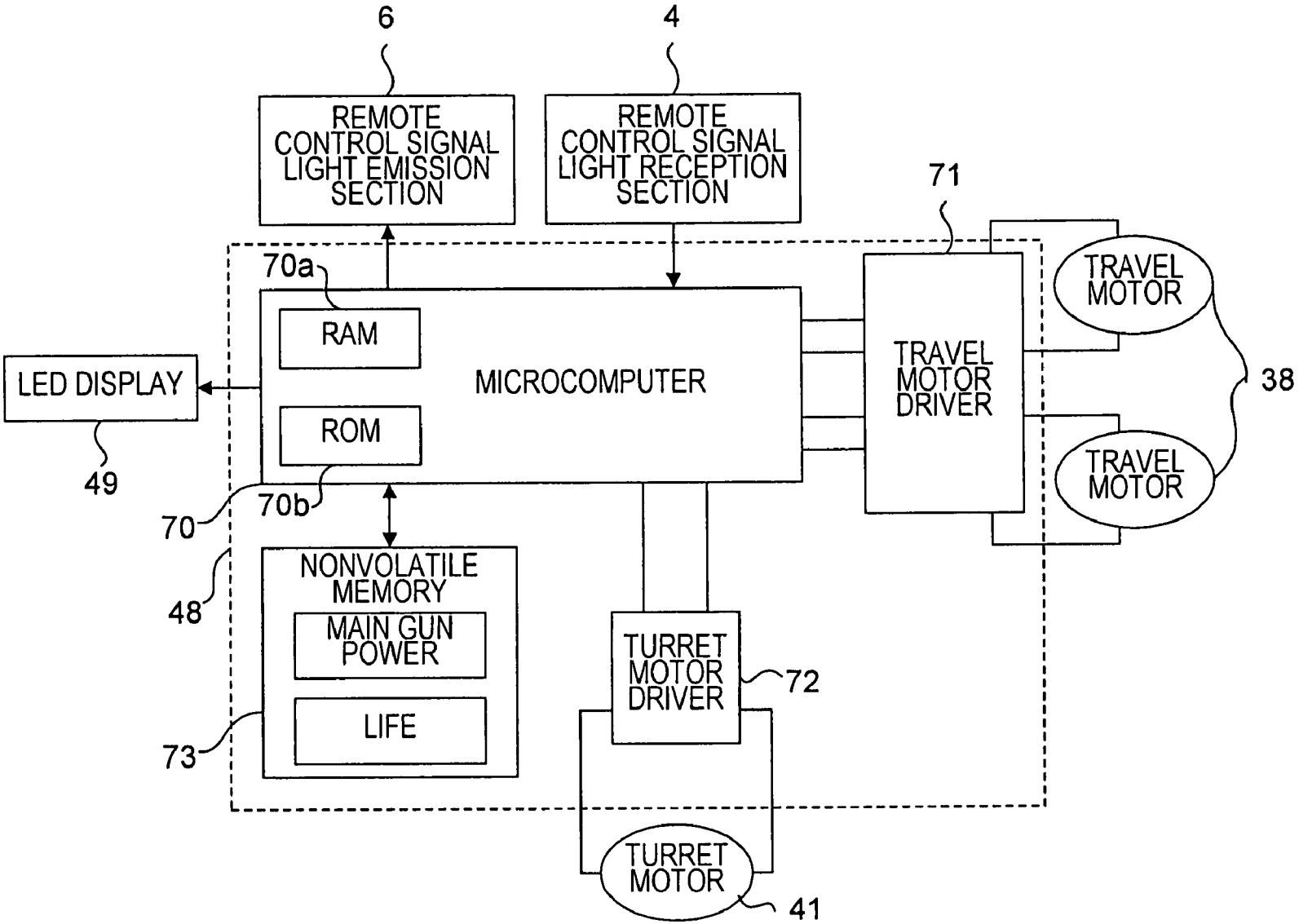
FIG. 5 is a diagram showing a circuit configuration of a tank model of FIG. 3.

FIG. 5 shows a circuit configuration of a control system mounted on the tank model 1. A remote control signal light reception section 4 for receiving signals from the transmitter 2 and other tank models 1 is provided on the tank model 1. The remote control signal light reception section 4 outputs a signal obtained by removable carrier components from received infrared rays, to a microcomputer 70. The microcomputer 70 decodes the signal supplied from the remote control signal light reception section 4 to remote control data of one block.

If the microcomputer 70 receives a signal from the transmitter 2 corresponding to itself, then the microcomputer 70 orders a travel motor driver 71 to drive the travel motors 38 . . . 38 and orders a turret motor driver 72 to drive the turret motor 41 on the basis of the received data. In addition, if the received data contains a firing order, then the microcomputer 70 generates data to be transmitted to another tank model 1, and orders the remote control signal light emission section 6 to transmit data at transmission timing based upon the time when data has been received from the transmitter 2. The reason why data is transmitted at transmission timing based upon the time when data has been received from the transmitter 2 is that interference caused by simultaneous transmission of remote control data from the transmitters 2 and the tank models 1 should be prevented. The remote control signal light reception section 6 includes a light emission device such as an LED.

A RAM 70*a* and a ROM 70*b* are mounted on the microcomputer 70 as main storage devices, and in addition, a nonvolatile memory 73 is connected to the microcomputer 70. On the nonvolatile memory 73, information of main gun power, which prescribes offensive power of firing of the tank model at a time and information of life, which prescribes a permitted level of an attack that can be suffered in one play, are recorded previously.

Besides them, an LED, which turns on or off or flashes according to the life change of the tank model 1, a secondary battery serving as a power supply, a power switch for switching ON/OFF the power supply, a power supply circuit for converting a current and a voltage supplied from the secondary battery to a predetermined current and a predetermined voltage, and an oscillator for supplying a clock signal to the microcomputer 70 are provided on the tank model 1 (they are not illustrated). Furthermore, a region for retaining an ID assigned to its own tank model 1 is also secured on the nonvolatile memory 73.

FIG. 6A shows an example of the main gun power and life recorded in the nonvolatile memory 73 of the tank model 1, and FIG. 6B shows an example of the number of shells and the charging time recorded on the nonvolatile memory 61 of the transmitter 2. As shown in FIGS. 6A and 6B, different values are set in each set of the tank model 1 and the transmitter 2 as these parameters according to the kind of the tank model 1. For example, if the kind of the tank model 1 is a tank A, then main gun power of 10 and a life of 40 are recorded on the tank model 1, and the number of shells 15 and a charging time of 5 seconds are recorded on the transmitter corresponding to the tank model 1. Furthermore, parameters determined for each kind of the tank model 1 are provided with relative strong points and weak points. For example, while the tank model A is as high as 10 in main gun power, it is as small as 15 in number of shells and as long as 5 seconds in charging time. On the other hand, while a tank model C is as low as 5 in main gun power, it is as large as 40 in number of shells and as short as 1.5 seconds in charging time. As a result, a battle between tank models 1 having different capabilities can be implemented and the interest of the remote control toy system can be increased.

Figure 7:
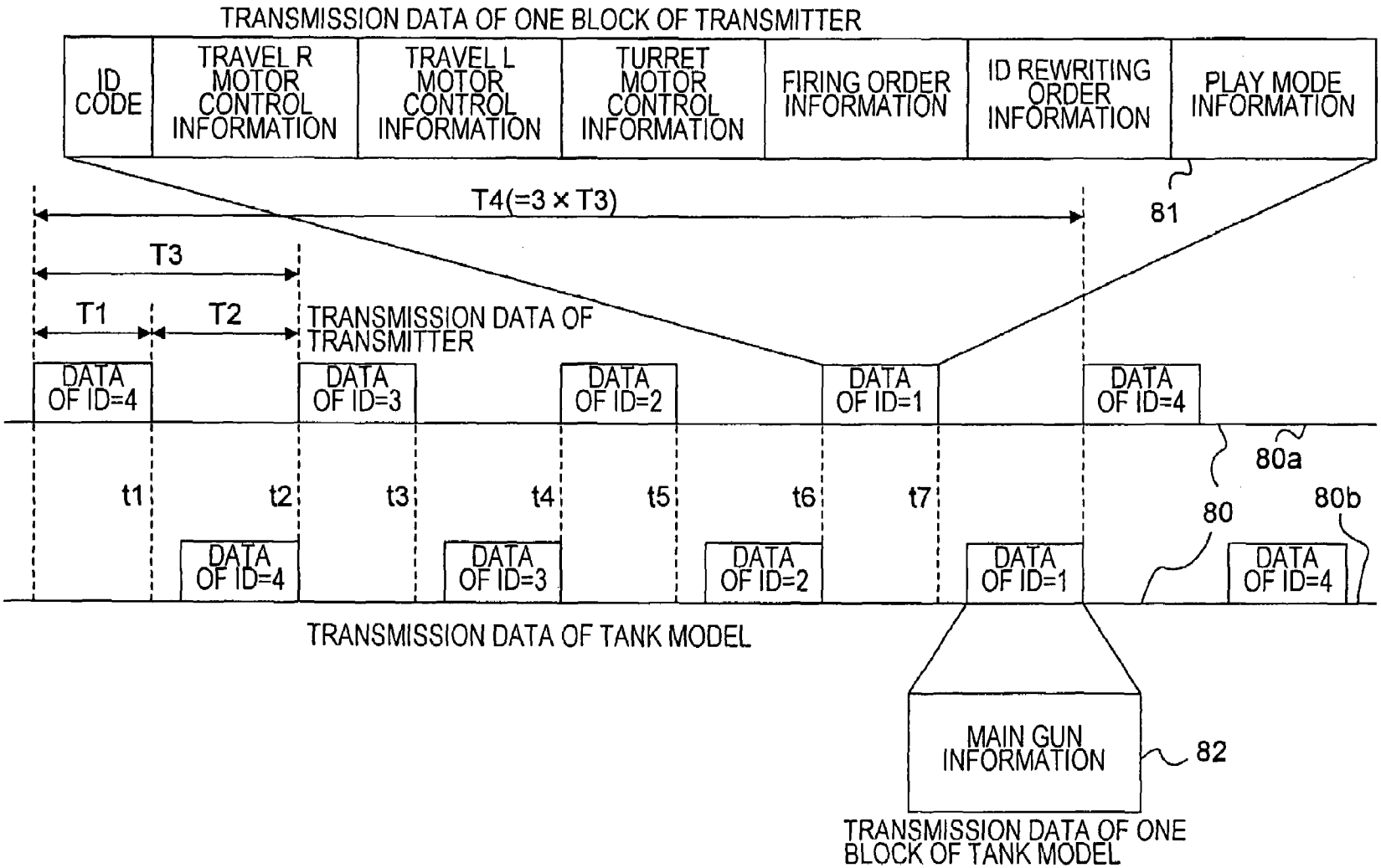
FIG. 7 is a diagram showing a data transmission schedule prescribing data transmission timing of a transmitter of FIG. 2 and a tank model of FIG. 3 so as not to overlap each other.

FIG. 7 shows a data transmission schedule prescribing data transmission timing of each transmitter 2 and each tank model 1 so as not to overlap each other. A time axis 80*a* of an upper column indicates the data transmission schedule of the transmitter 2. Between transmission time (time length T1) and transmission time (time length T1) of the transmitters 2, there is provided an interval having a length T2 during which transmission is not conducted by any transmitter 2. A time axis 80*b* of a lower column indicates a data transmission schedule of the tank model 1. Transmission time of the tank models 1 are disposed between transmission time and transmission time of the transmitters 2. Transmission data 81 indicates contents of remote control data of one block generated by the transmitter 2. Transmission data 82 indicates contents of remote control data of one block generated by the tank model 1. Hereafter, contents of transmission data and the data transmission schedule in the present embodiment will be described with reference to FIG. 7.

The remote control data of one block generated by the microcomputer 60 of the transmitter 2 includes an ID code, control information of the left and right travel motors, turret motor control information, firing order information and ID rewriting order information, and play mode information. In the ID code portion, data of, for example, 2 bits corresponding to an ID selected by the ID selection switch 18 is set. In each of the control information portions of the left and right travel motors, 1-bit data specifying the travel direction and 3-bit data specifying the velocity are set according to the operation position of the throttle stick 12 and the revolution/turret revolution stick 13. The reason why not only the throttle stick 12 but also the revolution/turret revolution stick 13 relates to the control information of the left and right travel motors is that the tank model 1 is revolved by a velocity difference between the left and right endless tracks 31. In the turret motor control information, 1-bit data for specifying whether revolution is to be effected and 1-bit data for specifying the rotation direction are set according to operations of the throttle stick 12, the turret revolution button 14, and the revolution/turret revolution stick 13. In the firing order information, 1-bit data for specifying whether firing is to be conducted is set on the basis of operation of the firing button 15. In the ID rewriting order information, 1-bit data for determining whether the remote control data is data for conducting operation control of the tank model 1 or data for altering the ID of the tank model 1 is set. In the play mode information, 2-bit information corresponding to the play mode selected by the play mode selection switch 17 is set. The number of bits in remote control data of one block is always fixed. Therefore, the time required for transmitting remote control data of one block is also constant.

Main gun power information is included in the remote control data of one block generated by the microcomputer 70 of the tank model 1. In the main gun power information, data corresponding to the main gun power retained by the microcomputer 70 is set. The number of bits in remote control data of one block is always fixed. Therefore, the time required for transmitting remote control data of one block is also constant.

When four sets of transmitters 2 and tank models 1 to be controlled by the transmitters, respectively having IDs 1 to 4 set therein are used simultaneously, transmission timing of each set is set so as to become different in transmission time period from other sets. In addition, in each set, transmission timing of the transmitter 2 is set so as to become different in transmission time period from the tank model 1. A time length during which the transmitter 2 and the tank model 1 of one set transmit remote control signals is T3. Each transmitter 2 and each tank model 1 repeat transmission of remote control signals with a period T4 (=4×T3) equivalent to the product of the number of sets and the transmission time length T3. Transmission timing of the sets is shifted one after another by T3 beginning from ID=4. In addition, the transmission time length T3 of each set is formed of a transmission time length T1 of the transmitter 2 and a subsequent time length T2 during which transmission by the tank model 1 is permitted. Each transmitter 2 and each tank model 1 manage transmission timing according to such relations. As a result, it becomes possible to prevent time periods of transmission from the four transmitters 2 and four tank models 1 from overlapping each other.

Such transmission control can be implemented by controlling transmission timing of, for example, the transmitter 2 and the tank model 1 having ID=3 shown in FIG. 7 as described below. First, as for the transmitter 2 (ID=3), upon receiving transmission data of the transmitter 2 having ID=4 at time t1, the transmitter 2 (ID=3) sets a transmission timer to T2 later and starts timer counting. T2 is a time period during which the tank model 1 having ID=4 is permitted to transmit data. At time t2 when the count of the transmission timer has advanced by time T2, the transmitter 2 (ID=3) starts transmission of its own data and completes the transmission at time t3 when T1 has elapsed from the start of the transmission. When the transmission has completed, the transmitter 2 checks received data and makes sure that signal interference has not occurred. Thereafter, the transmitter 2 (ID=3) sets a transmission timer for counting the next transmission timing to T2+3×T3 later, and starts timer counting. If a firing order is contained in the transmission data of the transmitter 2 (ID=3) received at time t3, then the tank model 1 (ID=3) transmits data during the time period T2 over which its own transmission is permitted since the reception completion. Upon receiving transmission data of the transmitter 2 having ID=2 at time t5, the transmitter 2 (ID=3) that has counted for transmission timing from the time t3 re-sets the transmission timer to T2+2×T3 later and starts timer counting. Upon receiving transmission data from the transmitter 2 having ID=1 at time t7, the transmitter 2 (ID=3) re-sets the transmission timer to T2+T3 later and starts timer counting. Thereafter, when a power supply of the transmitter 2 having ID=4 is cut off, or when data from the transmitter 2 having ID=4 cannot be received, the transmitter 2 (ID=3) may begin to output its own data when the count of the transmission timer has advanced by time T2+T3. Furthermore, also when a signal from another transmitter 2 cannot be received, it is possible to continue the data transmission with a period T4 (=4×T3) by using time T2+3×T3 set in the transmission timer when the transmission of its own data has been completed. Furthermore, since the transmitter 2 can continue data transmission in periods of T4, the tank model 1 that sets transmission timing on the basis of the time when it has received data from the transmitter 2 can also continue the data transmission.

The case where there are four sets of the transmitter 2 and the tank models 1 has been described. Even when the number of sets is five or more, the transmission timing can be controlled in the same way by adding IDs. The period of the transmission timing of each transmitter 2 and each tank model 1 becomes N×T3 (where N is the number of sets). However, it is also possible to interpose a blank interval during which neither the transmitter 2 nor the tank model 1 transmits data, between a time period during which the transmitter 2 transmits data and a time period during which the tank model 1 transmits data, and thereby set the entire period equal to longer than N×T3.

FIGS. 8 to 13 are flow charts showing a procedure of processing executed by the microcomputer 60 of the transmitter or the microcomputer 70 of there tank model 1 in power-on operation and ordinary operation.

Prior to description of these drawings, play modes selected by the play mode selection switch 17 will now be described. The play modes differ in methods of setting four parameters prescribing the power of the tank model 1, i.e., main gun power, life, the number of shells, and charging time. In an exercise mode, the life and the number of shells are limitless. The charging time is set equal to a predetermined value unified for all tank models 1. Since the life is limitless, it is not necessary to set the main gun power, which prescribes a value by which the life of an opponent of the battle can be decreased in firing at a time. Upon being fired upon, the tank model 1 invokes damage action. The damage action is, for example, operation of neutral turn, in which the tank model 1 is revolved on the spot by driving the left and right endless tracks 31 of the tank model 1 in directions opposite to each other, or operation of flashing the LED 49 provided on the tank model 1 with a predetermined period. The damage action is forcibly executed irrespective of the user's operation, in a random direction over a random time period. In a actual fighting mode, the main gun power, life initial value, and charging time are set equal to predetermined values unified for all tank models 1. The number of shells is limitless. When the tank model 1 is fired upon, the damage action is invoked. In addition, if the life becomes a predetermined value or less, then the tank model 1 suffers a penalty such as being limited in operation control. For example, if the life becomes 50% or less of the initial value, then the travel velocity is limited. If the life becomes 20% or less, then the LED 49 flashes continuously. If the life becomes 0, then the tank model 1 invokes a defeat action, such as conducting the neutral turn in a predetermined direction and turning off the LED, and thereafter the operation control is completely stopped. For effecting the remote control again, predetermined reset operation such as turning on the power of the tank model 1 again must be conducted. In an expert mode, values peculiar to the kind of the tank model 1 are set in the main gun power, the life initial value, the initial value of the number of shells, and the charging time as shown in FIG. 6. Operation and the like conducted when fired upon are the same as those in the actual fighting mode.

Figure 8:
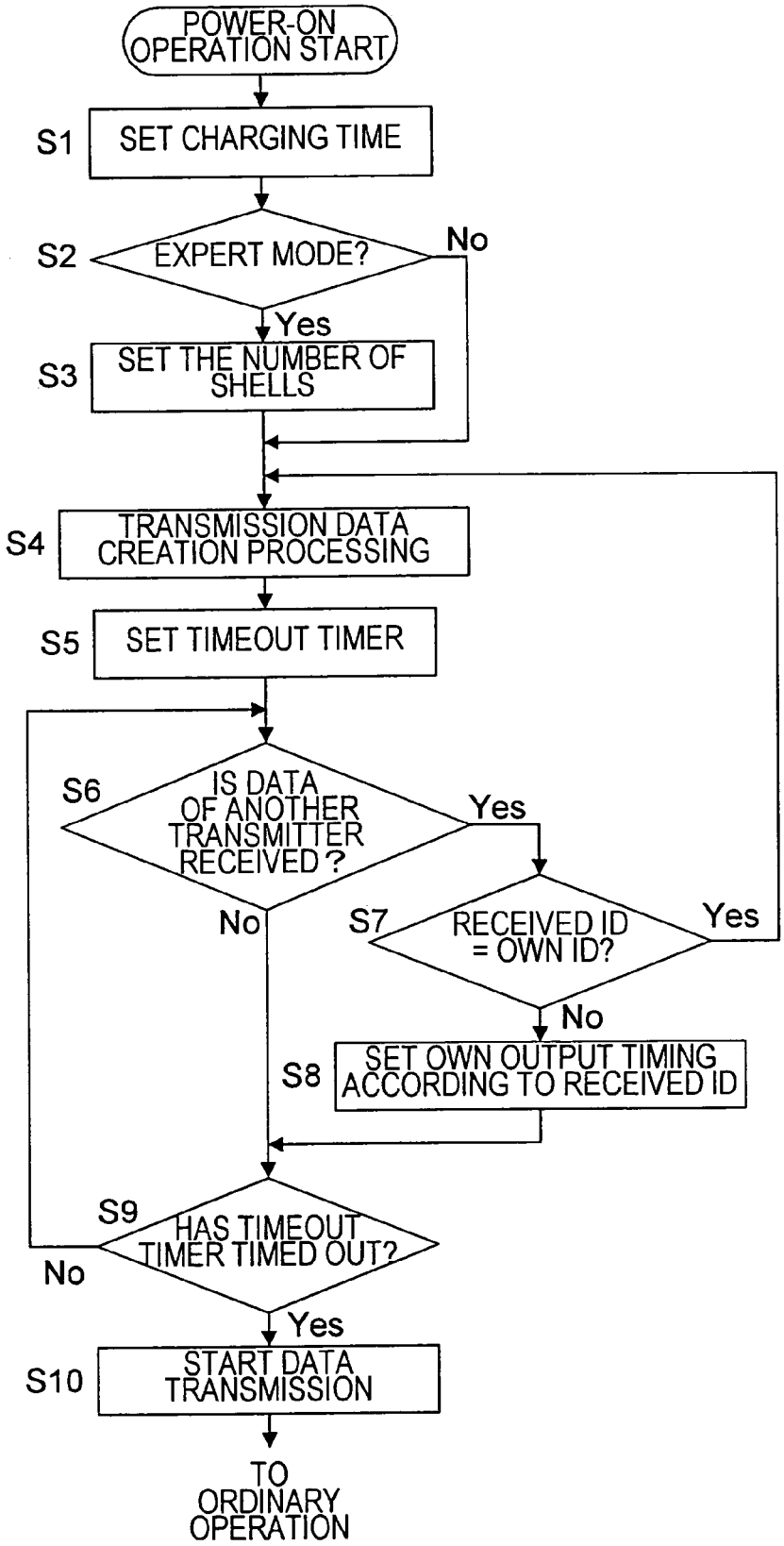
FIG. 8 is a flow chart showing a procedure of power-on operation executed by a microcomputer of a transmitter of FIG. 2 since a circuit for power supply is thrown in until transmission of data of the transmitter itself is started.

FIG. 8 is a flow chart showing a procedure of power-on operation executed by the microcomputer 60 of the transmitter 2 since a circuit for power supply is thrown in until transmission of data of the transmitter itself is started. If the circuit for power supply is thrown in, then the microcomputer 60 first reads a charging time corresponding to the play mode selected by the play mode selection switch 17, from the nonvolatile memory 61 and sets it (step S1). In the exercise mode or the actual fighting mode, charging time unified for all tank models 1 is set. In the expert mode, different values are set according to kinds of the tank model 1 as shown in FIG. 6B. Subsequently, the microcomputer 60 determines whether the mode is the expert mode (step S2). If the mode is the expert mode, then the microcomputer 60 reads the initial value of the number of shells from the nonvolatile memory 61 and sets it (step S3). If the mode is not the expert mode, then the microcomputer 60 skips the step S3. At step S4. the microcomputer 60 executes transmission data creation processing. The transmission data creation processing will be described later. At step S5, the microcomputer 60 sets a timer for timeout. Subsequently, the microcomputer 60 determines whether data from another transmitter has been received (step S6). If data from another transmitter has been received, then the microcomputer 60 determines whether the ID of the received data is the same as the ID set for its own transmitter 2 (step S7). If the IDs coincide with each other, then the microcomputer 60 returns to the step S4 and repeats the determining operation. As a result, interference when there are a plurality of transmitters 2 having the same ID is prevented. When it is determined at the step S7 that the IDs do not coincide with each other, then the microcomputer 60 sets its own transmission timing according to the ID of the other transmitter 2 (step S8). For example, if the transmitter 2 having ID=3 shown in FIGS. 6A and 6B has received data of ID=2, the microcomputer 60 sets its own transmission timing to T2+2×T3 time later.

Subsequently, the microcomputer 60 determines whether the timer set at the step S5 has times out (step S9). If the timer does not time out, then the microcomputer 60 returns to the step S6. If the timer times out, then the microcomputer 60 starts transmission of data for remote-controlling its own tank model (step S10). However, outputting is actually started when the transmission timing set at the step S8 is reached. If any data has not been received until the timeout, then single control is caused, i.e., other transmitters 2 do not exist, and consequently the microcomputer 60 starts immediately at the step S10.

Figure 9:
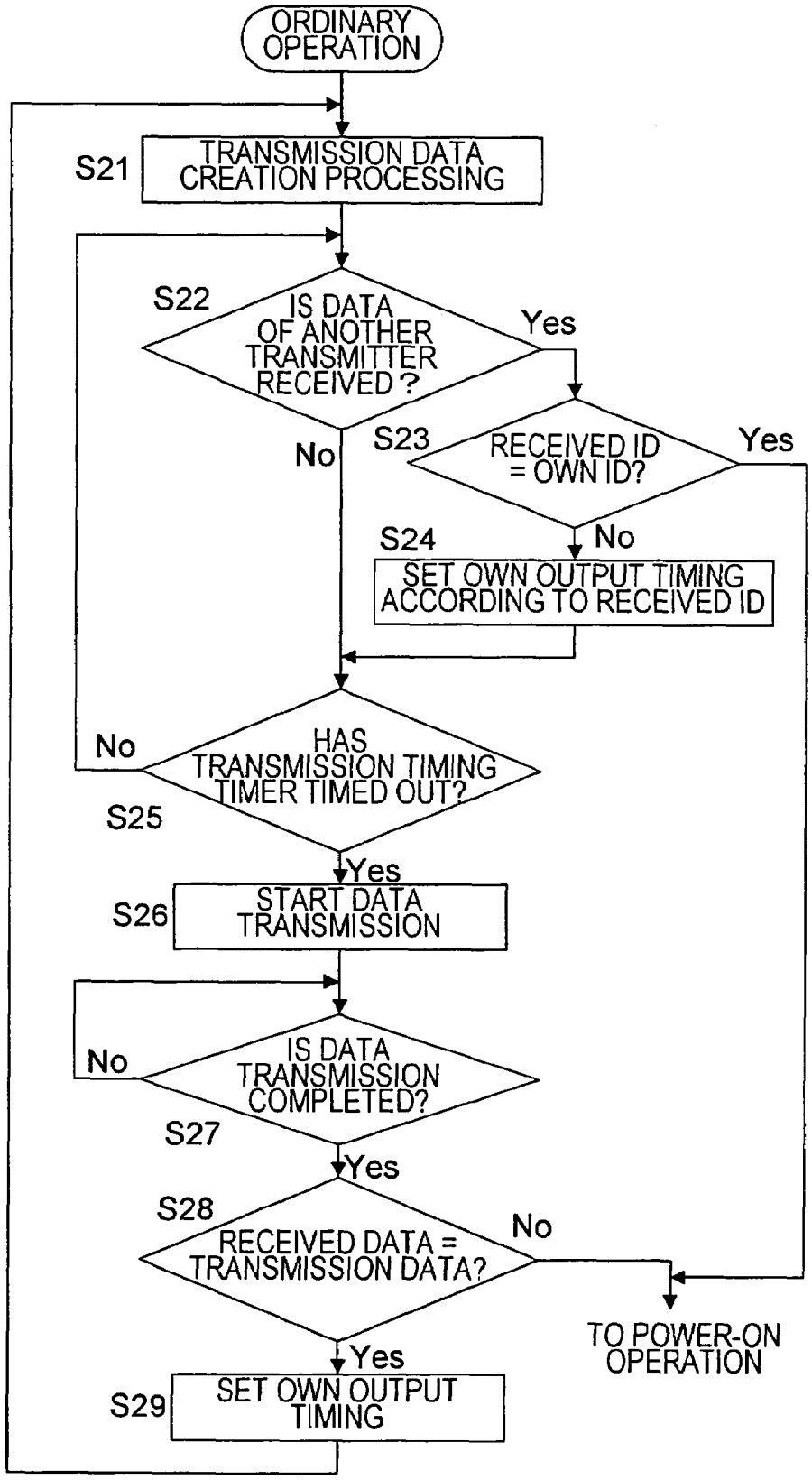
FIG. 9 is a flow chart showing a procedure of an ordinary operation executed by a microcomputer of a transmitter of FIG. 2 in the wake of processing of FIG. 8.

If the processing at the step S10 is finished, then the microcomputer 60 controls data transmission according to a procedure of ordinary operation shown in FIG. 9. In the ordinary operation, the microcomputer 60 first executes transmission data creation processing (step S21). The transmission data creation processing will be described later. Subsequently, the microcomputer 60 determines whether data from another transmitter 2 has been received (step S22). If data from another transmitter 2 has been received, then the microcomputer 60 determines whether the ID of the received data coincides with its own ID (step S23). If the IDs coincide with each other, then the microcomputer 60 returns to the power-on operation of FIG. 8. On the other hand, if the ID of the received data is different from its own ID, then the microcomputer 60 sets its own transmission timing in the transmission timer according to the ID of the received data (step S24). Subsequently, the microcomputer 60 determines whether the transmission timer has timed out (step S25). Until the timeout, the microcomputer 60 returns to the step S22.

If the transmission timer is judged to have timed out at the step S25, then the microcomputer 60 starts transmission of its own data (step S26). At this time, data reception is conducted in parallel. Subsequently, the microcomputer 60 determines whether the data transmission has been completed (step S27). If the transmission has been completed, then the microcomputer 60 compares the transmitted data with data received in parallel with the transmission (step S28). If the transmitted data does not coincide with the received data, then the microcomputer 60 judges interference to have occurred, and proceeds to the power-on operation of FIG. 8. If the transmitted data coincides with the received data, then it can be considered that there is no interference, and consequently the microcomputer 60 sets transmission timing of the next time in the transmission timer (step S29). Thereafter, the microcomputer 60 returns to the step S21.

As for remote control data output when the ID rewriting button is pressed, interference can be prevented by conducting isolation from other movable machines when rewriting the ID, or by providing a remote control signal light emission section different from the remote control signal light emission section 6 exclusively for ID rewriting data so as to prevent the data from being transmitted to a region where movable machines are fighting a battle. Therefore, the remote control data output when the ID rewriting button is pressed may not be transmitted according to the processing procedure shown in steps S22 to S29.

Figure 10:
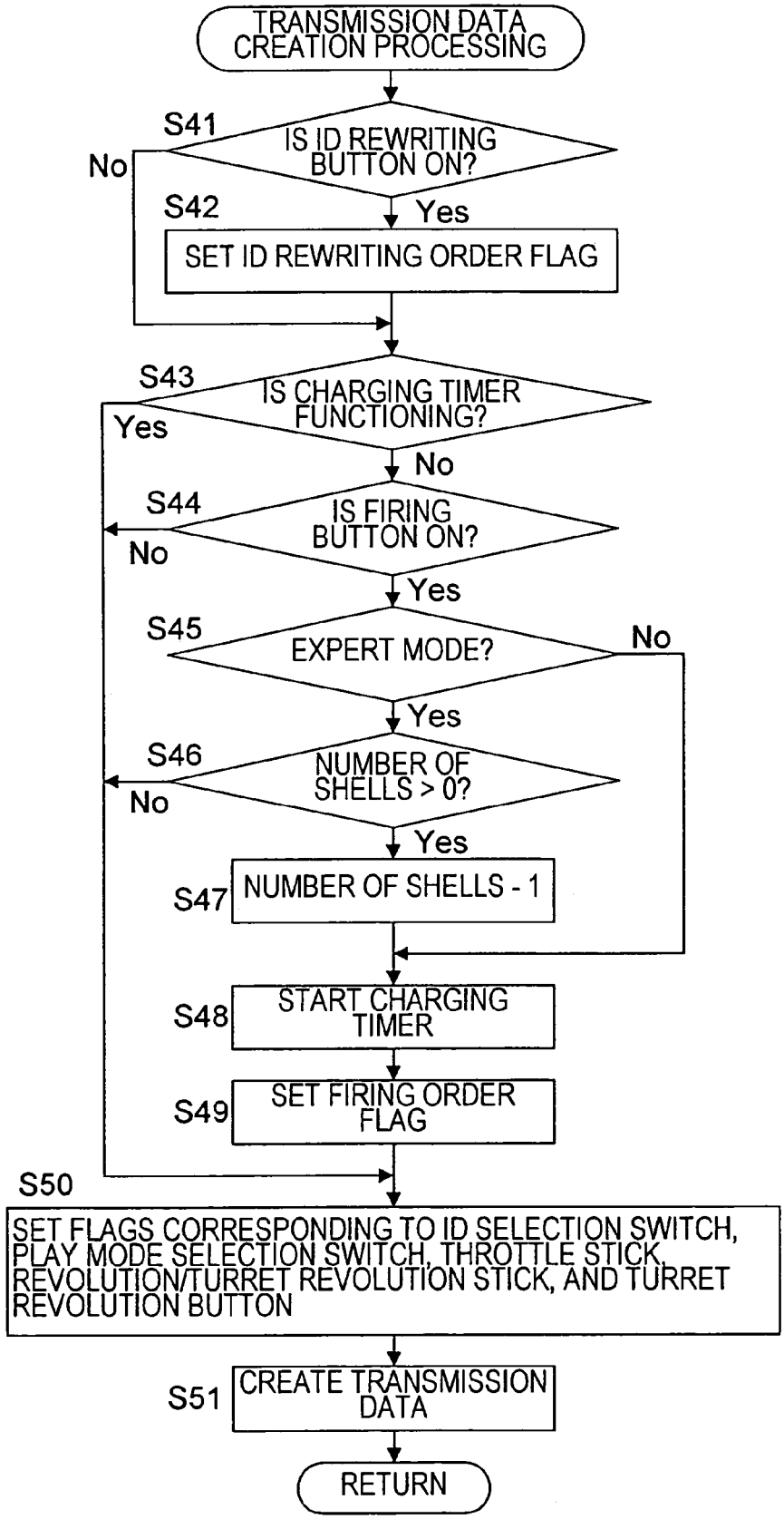
FIG. 10 is a flow chart showing a procedure of transmission data creation processing executed by a microcomputer of a transmitter of FIG. 2 in processing of FIGS. 8 and 9.

FIG. 10 is a flow chart showing the procedure of transmission data creation processing executed by the microcomputer 60 at the step S4 of FIG. 8 and step S21 of FIG. 9. At step S41, the microcomputer 60 determines whether the ID rewriting button is pressed. If the ID rewriting button is judged to be pressed, then the microcomputer 60 sets an ID rewriting order flag (step S42). If the ID rewriting button is judged to be not pressed, then the microcomputer 60 skips the step S42, At step S43, the microcomputer 60 determines whether a charging timer is functioning. The charging timer is provided to count time in order to determine whether charging time has elapsed after firing. If the charging timer is judged to be functioning, then the microcomputer 60 skips steps S44 to S49. In other words, the microcomputer 60 disregards the operation on the firing button 15. If the charging timer is judged to be not functioning, then the microcomputer 60 determines whether the firing button has been pressed (step S44). If the firing button is judged to have not been pressed, then the microcomputer 60 skips steps S44 to S49. If the firing button is judged to have been pressed, then the microcomputer 60 determines whether the mode is the expert mode (step S45). If the mode is judged to be not the expert mode, then the microcomputer 60 skips steps S46 and S47. If the mode is judged to be the expert mode, then the microcomputer 60 determines whether the number of shells is greater than 0 (step S46). If the number of shells is judged to be 0 or less, then the microcomputer 60 skips steps S47 to S49. In other words, the microcomputer 60 judges the operation on the firing button 15 to be invalid and does not execute processing for ordering the tank model 1 to fire. If the number of shells is judged to be greater than 0, then the microcomputer 60 decreases the number of shells by one (step S47). Subsequently, the microcomputer 60 starts counting in the charging timer (step S48) and sets a firing order flag for making the transmission data contain a firing order (step S49). In addition, the microcomputer 60 sets flags corresponding to other input devices of the transmitter 2 (step S50), and creates transmission data with reference to these flags (step S51). After creating the transmission data, the microcomputer 60 resets the flags, and effect preparations for the next transmission data creation processing.

Thus, in the expert mode, the number of shells recorded in the nonvolatile memory 61 is set as the initial value of the number of shells retained by the microcomputer 60 at the step S3. The firing order is limited at the step S46. The number of shells is decreased at the step S47. As a result, the transmitter 2 can manage the number of times the tank model 1 can fire. In addition, it is possible to make the user recognize the number of shells by displaying the number of shells retained by the microcomputer 60 on the seven-segment display section 16 of the transmitter 2. If the tank model 1 is made to manage the number of shells, it is necessary to provide a display section of the number of shells on the tank model 1 or provide a device that feeds back data for displaying the number of shells on the transmitter 2 from the tank model 1. But according to the above transmitter 2, such a necessity is eliminated and the tank model 1 can be advantageously reduced in size. As for the charging time as well, the charging time recorded on the nonvolatile memory 61 is set in the charging time used by the microcomputer 60 at the step S1. The charging time is counted at the step S48. The firing order is limited at the step S43. As a result, the transmitter 2 can manage the time intervals at which the tank model 1 can fire in succession. As compared with the case where the tank model 1 manages the time intervals, the burden of the tank model 1 can be lightened.

Figure 11:
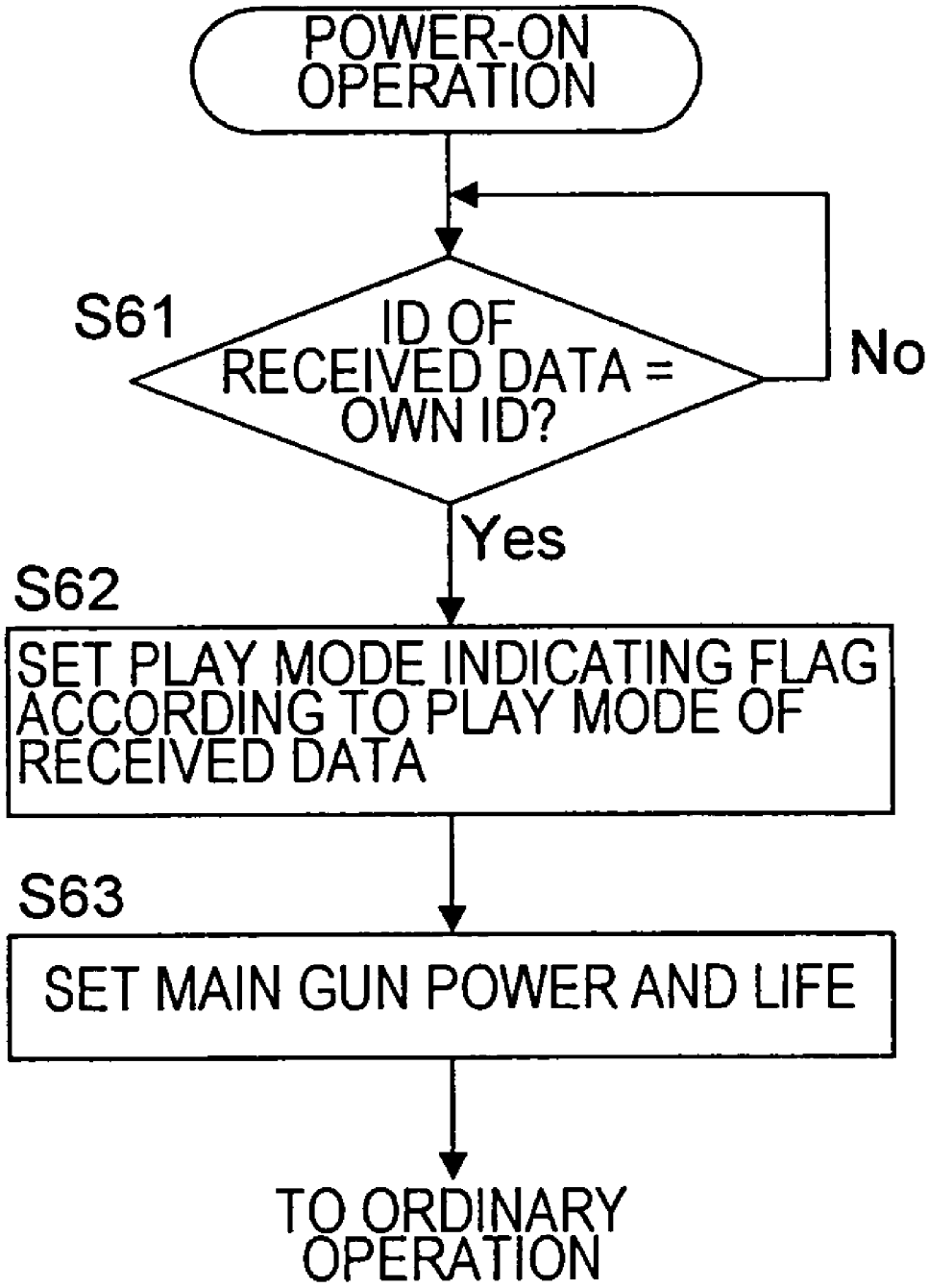
FIG. 11 is a flowchart showing a procedure of power-on operation executed by a microcomputer of a tank model of FIG. 3 since a circuit for power supply is thrown in until initialization is conducted.

FIG. 11 is a flow chart showing a procedure of the power-on operation executed by the microcomputer 70 of the tank model 1 when a circuit for power supply is thrown in. First, the microcomputer 70 determines whether an ID contained in the received data coincides with an ID assigned to itself (step S61). If the IDs are judged to not coincide with each other, then the microcomputer 70 waits for the next reception. If the IDs are judged to coincide with each other, i.e., if the data is judged to be data transmitted from the transmitter 2 corresponding to its own tank model 1, then the microcomputer 70 sets a flag that indicates the selected play mode according to play mode information contained in received data (step S62). This flag is retained until predetermined reset operation such as turning on power again is effected, and referred to in the ensuing processing as occasion demands. Subsequently, the microcomputer 70 reads the main gun power and life associated with the selected play mode from the nonvolatile memory 73 and sets them (step S63). If the selected play mode is a actual fighting mode, a value unified for all tank models 1 is set in the life. In the case of the expert mode, values according to the kind of each tank model 1 as shown in FIG. 6A are set in the main gun power and life. After setting the main gun power and life, the microcomputer 70 advances to the ordinary operation.

Figure 12:
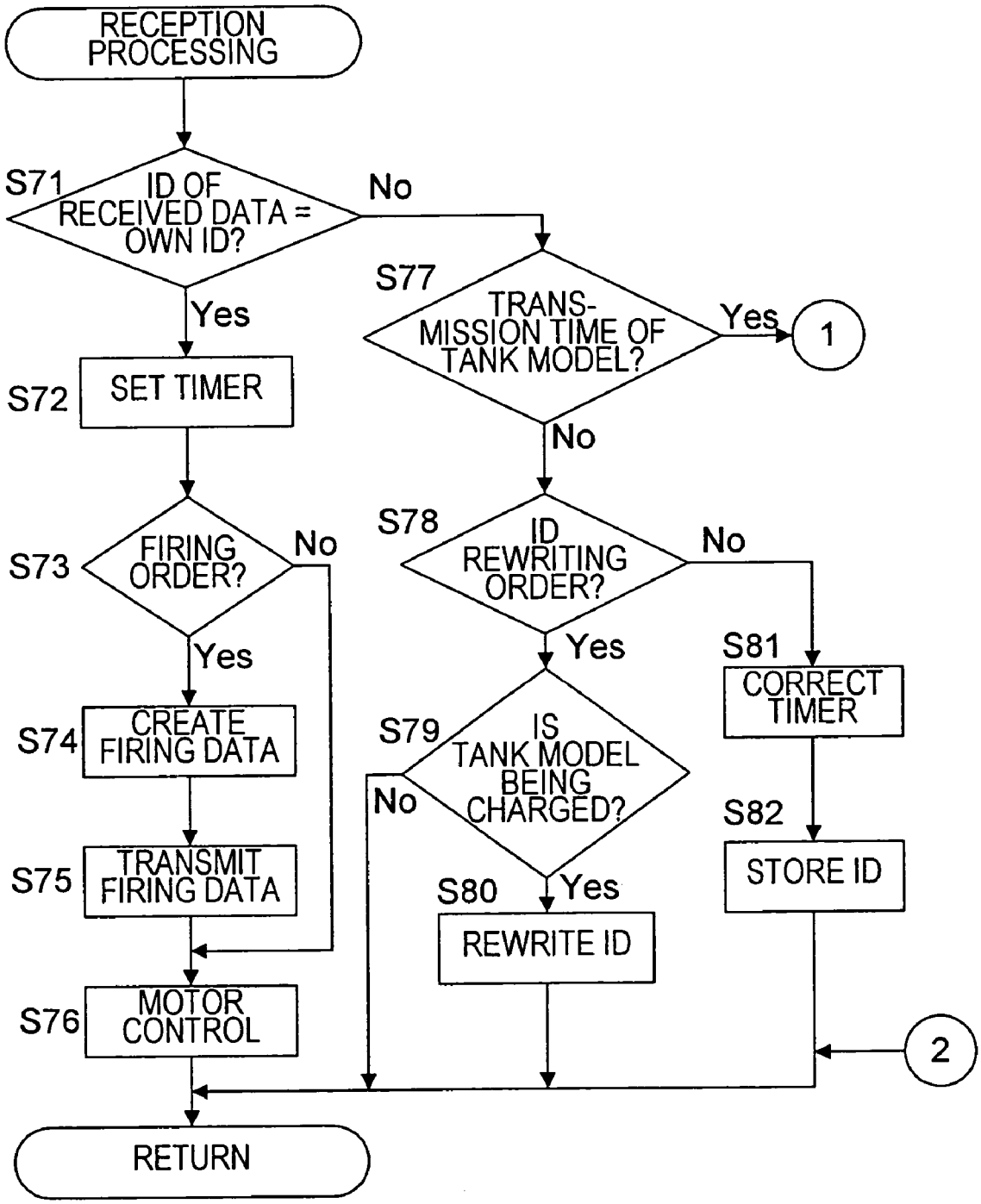
FIG. 12 is a flow chart showing a procedure of an ordinary operation executed by a microcomputer of a tank model of FIG. 3 in the wake of processing of FIG. 11.

FIG. 12 is a flowchart showing a reception processing procedure executed by the microcomputer 70 of the tank model 1 when the microcomputer 70 has received data from the remote control signal light reception section 4. First, the microcomputer 70 determines whether an ID contained in received data coincides with an ID assigned to its own tank model 1 (step S71). If the IDs coincide with each other, i.e., if the microcomputer 70 judges the received data to be data transmitted from the transmitter 2 corresponding to its own tank model 1, then the microcomputer 70 sets a timer so as to be able to refer to the data transmission schedule of FIG. 7 corrected in time axis by taking the time when the data has been received as a criterion (step S72).

By using this timer, the microcomputer 70 can adjust transmission timing of its own tank model 1, and determine whether the received data is data supplied from the transmitter 2 or data supplied from another tank module 1, on the basis of the time when the data has been received. The timer setting and reference to the data transmission schedule can be conducted, for example, as follows. First, when remote control data having the same ID as the ID assigned to its own tank model 1 (i.e., transmission data from the transmitter 2 corresponding to its own tank model 1) has been received, the microcomputer 70 sets time T2 in the timer when the reception is completed and sets a flag indicating that the it is the transmission time of the tank model 1. Thereafter, the microcomputer 70 repeats operation of re-setting T1 and resetting the flag when the timer count has advanced by the time T2, and re-setting time T2 and setting the flag when the timer count has advanced by the time T1. As a result, it is possible to determine whether the time when the data is received is transmission time of the transmitter 2 or transmission time of the tank model 1. Furthermore, when a counter variable is prepared, the microcomputer 70 initializes the counter variable at the transmission time of its own tank model 1 and thereafter increments the counter variable every time the microcomputer 70 sets the flag indicating that the transmission time is that of the tank model 1. By doing so, the microcomputer 70 can know its own transmission timing even if transmission data from the transmitter 2 corresponding to its own tank model 1 is interrupted. Furthermore, the microcomputer 70 can discriminate the ID of the received remote control data.

After setting the timer at the step S72, the microcomputer 70 determines whether firing order information contained in the received data contains a firing order (step S73). If the firing order is contained, then the microcomputer 70 generates firing data to be transmitted to another tank model 1 (step S74). The microcomputer 70 makes the firing data contain information of the main gun power set in the power-on operation. Subsequently, the microcomputer 70 transmits the firing data at predetermined timing (step S75). If there is no firing order at the step S73, the microcomputer 70 skips the steps S74 and S75. Thereafter, the microcomputer 70 conducts motor control on the basis of control information of the left and right travel motors and control information of the turret motor contained in the received data (step S76), and waits for the next reception.

If the ID contained in the received data does not coincide with the ID assigned to its own tank model 1 at the step S71, then the microcomputer 70 compares the time of reception with the data transmission schedule set at the step S72 and determines whether the time of reception is time when another tank model 1 is to transmit (step S77). If the microcomputer 70 judges the time of reception to be not the transmission time of the tank model 1 (i.e., judges the data to be transmission data from the transmitter 2), then the microcomputer 70 determines whether an ID rewriting order is contained in the received data (step S78). If the ID rewriting order is judged to be contained, then the microcomputer 70 determines whether its own tank model 1 is being charged (step S79). If its own tank model 1 is being charged, then the microcomputer 70 changes its own ID to the ID contained in the received data (step S80) and waits for the next reception. If its own tank model 1 is not being charged, then the microcomputer 70 skips the step S80. If the ID rewriting order is judged to be not contained at the step S78, then the microcomputer 70 re-sets T2 in a timer for referring to the data transmission schedule, and thereafter repeats counting and setting of the T2 and T1, and thereby corrects the data transmission schedule (step S81). Subsequently, the microcomputer 70 sets the ID contained in the received data, in the variable for storing the ID of the received data (step S82).

Figure 13:
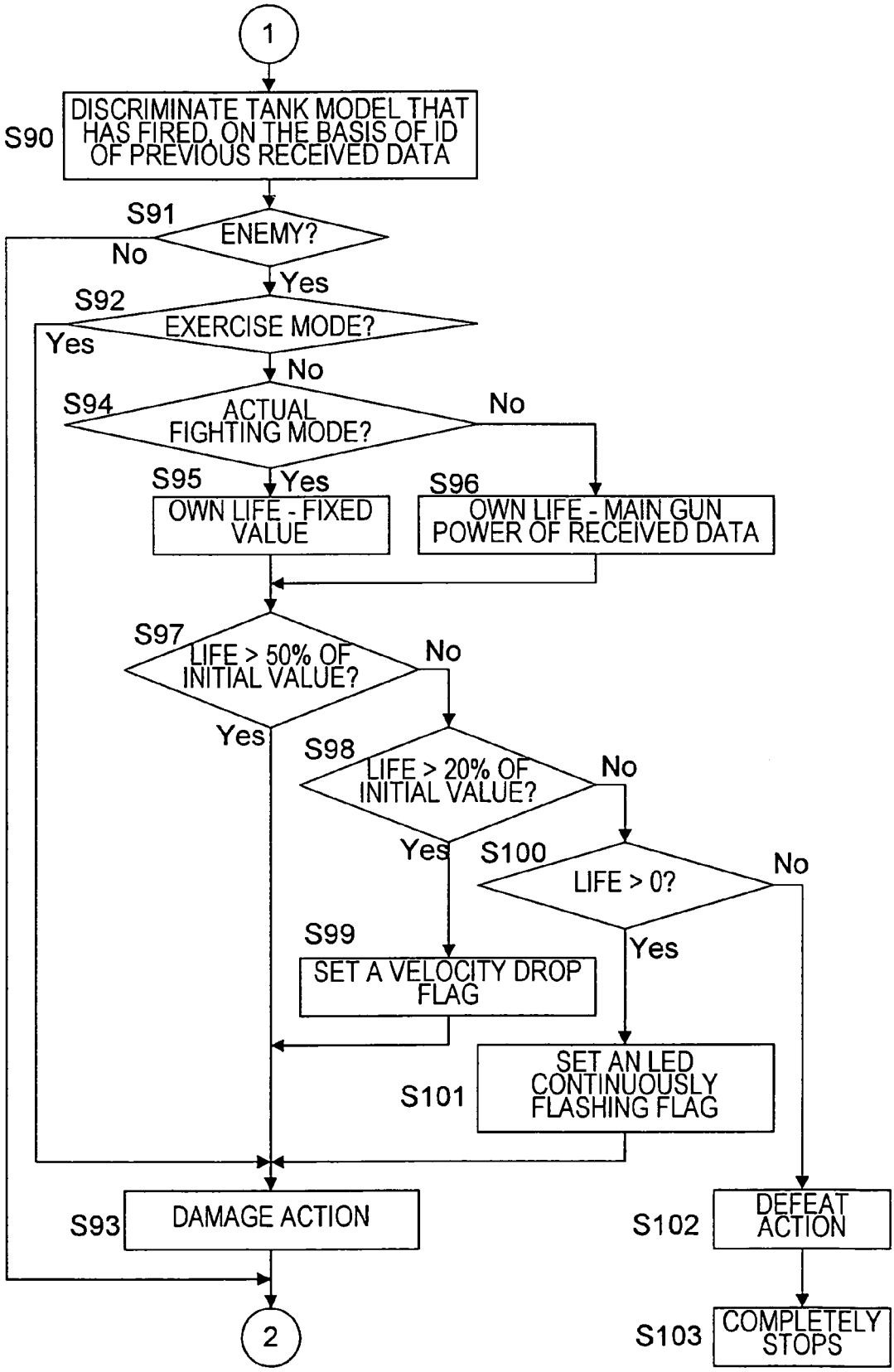
FIG. 13 is a flow chart showing a procedure executed by a microcomputer of a tank model of FIG. 3 when received data is supplied from another tank model, in processing of FIG. 12.

When the time of reception is judged to be the transmission time of another tank model 1 at the step S77, the microcomputer 70 proceeds to processing to be conducted when firing is effected shown in FIG. 13. At step S90, the microcomputer 70 refers to the ID substituted at the step S82 (see FIG. 12). Since in the present embodiment the transmission time of the transmitter 2 is followed by the transmission time of the corresponding tank model 1, the ID of the tank model 1 that has fired can be discriminated by using the referred ID. By previously setting an ID judged to be an enemy in the microcomputer 70, therefore, it is possible to determine whether the tank model 1 that has fired is an enemy, on the basis of the discriminated ID (step S91). If the tank model 1 that has fired is judged to be not an enemy, then the microcomputer 70 skips the ensuing processing shown in FIG. 13, returns to steps shown in FIG. 12, and waits for the next reception. If the tank model 1 that has fired is judged to be an enemy, then the microcomputer 70 determines whether the mode is an exercise mode (step S92). If the mode is judged to be the exercise mode, then the microcomputer 70 invokes the damage action (step S93), then returns to steps shown in FIG. 12, and waits for the next reception. If the mode is judged to be not the exercise mode, then the microcomputer 70 determines whether the mode is a actual fighting mode (step S94). If the mode is judged to be not the actual fighting mode, then the microcomputer 70 subtracts a predetermined value unified for all tank models 1 from its own life (step S95). If the mode is judged to be not the actual fighting mode, then the microcomputer 70 subtracts the value of the main gun power contained in the received data from its own life (step S96). Subsequently, the microcomputer 70 determines whether the life is greater than 50% of the initial value (the value read from the nonvolatile memory 73 and set at the step S63 of FIG. 11) (step S97). If the life is judged to be greater than 50%, then the microcomputer 70 invokes the damage action (step S93), thereafter returns to steps of FIG. 12 and waits for the next reception. If the life is judged to be 50% or less, then the microcomputer 70 determines whether the life is greater than 20% of the initial value (step S98). If the life is judged to be greater than 20%, then the microcomputer 70 sets a velocity drop flag (step S99), invokes the damage action, and waits for the next reception. Thereafter, until a predetermined reset operation is conducted on the tank model 1, the microcomputer 70 generates a predetermined velocity limit by referring to the velocity drop flag when executing the control of the travel motor 38. If the life is judged to be 20% or less, then the microcomputer 70 determines whether the life is greater than 0 (step S100). If the life is judged to be greater than 0, then the microcomputer 70 sets an LED continuously flashing flag (step S101), invokes the damage action, and waits for the next reception. Thereafter, until a predetermined reset operation is conducted on the tank model 1, the microcomputer 70 makes the LED 49 continuously flash by referring to the LED continuously flashing flag. If the life is judged to be 0 or less, then the microcomputer 70 invokes the defeat action (step S102) and completely stops the control of the tank model 1 (step S103).

In this way, the main gun power and life are set from the nonvolatile memory 73 at the step S63. At the step S75, the information of the main gun power is included in the firing data. At step S96, the main gun power of the received data is subtracted from the own life, and the operation, such as the complete stop at the step S103, is conducted on the basis of a resultant value. As a result, a system for generating different effects by using offensive power set every tank model 1 is completed among the tank models 1 . . . 1. Therefore, it is not necessary to feedback data from the tank model 1 to the transmitter 2, and complication of the configuration of the remote control toy system is not caused.

The decision of the step S77 as to whether data is data transmitted from another tank model may also be executed as follows: 1-bit information for identifying whether the data is data from the transmitter 2 or data from the tank model 1 is added to each of the transmission data of the transmitter 2 and the transmission data of the tank model 1, and the microcomputer 70 refers to that information contained in the received data. Determination as to which tank model 1 has transmitted the data may also be conducted as follows: the ID assigned to the transmitting tank model 1 is added to the transmission data, and the microcomputer 70 refers to the ID contained in the received data.

The present invention is not limited to the embodiments heretofore described, but may be embodied in various forms. For example, the movable machines are not limited to tanks, but may be machines simulating various movable bodies. The light reception section of the movable machine is not limited to a single one, but a plurality of light reception sections may also be provided. It is possible to use a part of the light reception sections in order to receive transmission data from transmitters and use remaining light reception sections in order to receive transmission data from other movable machines. The remote control signals may not be infrared rays. In addition, it is also possible to use radio waves as remote control signals of transmitters and use infrared rays as remote control signals of movable machines. In this way, different signals may be used for transmitters and movable machines. As for association of transmitters with movable machines, it is not necessary to use identification information contained in the remote control signal, but remote control signals differing in frequency may also be used. The device for preventing interference of remote control signals is not limited to a device for adjusting the transmission timing, but maybe a device using remote control signals differing in frequency. The transmitters may be those that can be held by operators, or may be stationary transmitters. It is possible to install a specific program in a portable machine, such as a portable game machine or portable telephone, and make the portable machine function as a transmitter.

The present invention has been described by taking parameters, such as the main gun power and life, as an example of parameters retained in the movable machine. However, the present invention is not limited to such an example. Furthermore, so long as the transmission data can contain the offensive power, and processing differing in degree of damage according to the offensive power can be implemented, the present invention can be applied to all parameters. The present invention has been described by taking parameters, such as the number of shells and charging time, as an example of parameters retained in the transmitter. However, the present invention is not limited to such an example. So long as parameters are parameters used when a movable machine is controlled directly by a transmitter, the present invention can be applied to all parameters. It is also possible that the charging time is retained by a movable machine and after firing is conducted once, a firing order contained in transmission data from a transmitter is disregarded until the charging time has elapsed. Furthermore, in the present embodiment, there has been shown an example in which information concerning one parameter is included in the transmission data of the movable machine and computation is conducted on one parameter among parameters retained in the movable machine. However, it is also possible that information concerning a plurality of parameters is included in the transmission data and computation is conducted on a plurality of parameters retained in the movable machine. At this time, composite computation may be conducted by using a plurality of parameters as if computation is conducted on one parameter. While an example in which various parameters are set in the nonvolatile memory by a manufacturer has been shown, various parameters may be set by the user.

As heretofore described, according to the present invention, information concerning offensive power of a movable machine is included in an attack signal to be transmitted to another movable machine. When it is found by receiving an attack signal that an attack has been conducted by another movable machine, predetermined processing is executed so as to make the degree of damage differ according to offensive power specified by information concerning the offensive power contained in the attack signal. As a result, a remote control toy system capable of conducting attack differing in offensive power from movable machine to movable machine can be implemented. In addition, a movable machine of the present invention can discriminate offensive power of another movable machine on the basis of offensive power information contained in the received attack signal. Therefore, it is not necessary to store information such as a data table for discriminating the offensive power of another movable machine. Therefore, it is possible to deliver an attack that differs in power from movable machine to movable machine against another movable machine and enhance the interest of a game, without complicating the system configuration or increasing the production cost.

What is claimed is:

1. A remote control toy system including:

a plurality of sets each including a transmitter and a movable machine controlled on the basis of a control signal transmitted from the transmitter, a predetermined attack signal being transmitted from the movable machine on the basis of an attack order, which is contained in the control signal, transmitted from the transmitter in response to a predetermined attack operation of a user, a predetermined processing for causing damage due to an attack being executed in a movable machine that has received the attack signal, wherein the movable machine comprises:

a movable machine storage device for storing offensive power information, which indicates own offensive power;

an attack signal generation device for generating an attack signal of different strengths based on programmed parameters of the movable machine, so as to contain the offensive power information or information associated with the offensive power information;

an attack signal transmission device for transmitting the generated attack signal; and a damage generation device for discriminating the offensive power from the received attack signal and executing the predetermined processing so as to make a degree of damage different according to the offensive power.

2. The remote control toy system according to claim 1, wherein the movable machine storage device further stores damage degree discrimination information for discriminating the degree of damage, and the damage generation device changes the damage degree discrimination information so as to increase the damage as the offensive power discriminated from the received attack signal becomes greater.

3. The remote control toy system according to claim 1, wherein the transmitter comprises an attack order limiting device for limiting inclusion of the attack order in the control signal when a predetermined condition is satisfied.

4. The remote control toy system according to claim 3, wherein the transmitter comprises a transmitter storage device for storing required time information that indicates time required between an attack and next attack, until the required time elapses after the attack order is included in the control signal, the attack order limiting device prohibits inclusion of the next attack order in the control signal.

5. The remote control toy system according to claim 4, wherein permissible attack number information for specifying the number of times of permissible attack is further stored in the transmitter storage device, and the attack order limiting device updates the permissible attack number information whenever the attack order is included in the control signal, and prohibits inclusion of the attack signal in the control signal after the number of times of permitted attacks discriminated by the permissible attack number information has arrived at a predetermined value.

6. The remote control toy system according to claim 5, wherein the movable machine comprises a movable machine nonvolatile memory for recording initial states of the offensive power information and the damage degree discrimination information, and when predetermined reset operation is conducted, the offensive power information and the damage degree discrimination information stored in the movable machine storage device are made initial states recorded in the movable machine nonvolatile memory, and the transmitter comprises a transmitter nonvolatile memory for recording initial states of the required time information and the permissible attack number information, and when predetermined reset operation is conducted, the required time information and the permissible attack number information stored in the transmitter storage device are made initial states recorded in the transmitter nonvolatile memory.

7. The remote control toy system according to claim 5, wherein the transmitter comprises display device for displaying the permissible attack number information.

8. A remote control toy system including a plurality of sets each including a transmitter and a movable machine controlled on the basis of a control signal transmitted from the transmitter, a predetermined attack signal being transmitted from the movable machine on the basis of an attack order contained in the control signal and transmitted from the transmitter in response to a predetermined attack operation of a user, predetermined processing for causing damage due to an attack being executed in a movable machine that has received the attack signal, wherein each of the transmitters comprises:

a control signal generation device for generating a control signal that includes identification information peculiar to each transmitter for identifying each transmitter, operation control information for controlling operation of the movable machine, and information concerning the attack order;

a control signal transmission device for transmitting the control signal;

a control signal reception device for receiving a control signal transmitted from another transmitter;

a transmission timing setting device for setting transmission timing of the own control signal on the basis of the identification information contained in the received control signal; and a control signal transmission control device for causing the control signal transmission device to transmit the control signal according to the set transmission timing, each of the movable machines comprises:

an attack signal generation device for generating an attack signal of different strengths based on programmed parameters of the movable machine, so as to contain the offensive power information or information associated with the offensive power information;

an attack signal transmission device for transmitting the generated attack signal; and a control and attack signal reception device for receiving a control signal transmitted from each transmitter and an attack signal transmitted from another movable machine;

a movable machine control device responsive to reception of a control signal containing identification information peculiar to a transmitter associated with the own movable machine, for controlling operation of the own movable machine on the basis of operation control information contained in the control signal and controlling generation and transmission of the attack signal on the basis of an attack order contained in the control signal; and a damage generation device responsive to reception of an attack signal from another movable machine, for discriminating the offensive power from the received attack signal and executing the predetermined processing so as to make a degree of damage different according to the offensive power, for each of the transmitters and movable machines, a common signal transmission schedule prescribing transmission timing of the control signal and the attack signal so as to prevent overlapping each other is set, the transmission timing setting device of the transmitter refers to identification information contained in the control signal from another transmitter to discriminate transmission timing of the transmitter itself prescribed in the signal transmission schedule, and the movable machine control device refers to reception timing of a control signal transmitted from at least one transmitter among the transmitters to discriminate its own transmission timing prescribed in the signal transmission schedule, and causes the attack signal transmission device to transmit the attack signal according to the discriminated transmission timing.

* * * * *